US009753395B2

(12) United States Patent
Ikada et al.

(10) Patent No.: US 9,753,395 B2
(45) Date of Patent: Sep. 5, 2017

(54) IMAGE FORMING APPARATUS ACQUIRING A DURATION OF OVERCHARGE

(71) Applicant: CANON KABUSHIKI KAISHA, Tokyo (JP)

(72) Inventors: Kosuke Ikada, Numazu (JP); Shinichi Agata, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/222,338

(22) Filed: Jul. 28, 2016

(65) Prior Publication Data

US 2017/0031260 A1 Feb. 2, 2017

(30) Foreign Application Priority Data

Jul. 31, 2015 (JP) ..... 2015-152509

(51) Int. Cl.
*G03G 15/00* (2006.01)
*G03G 15/02* (2006.01)
(Continued)

(52) U.S. Cl.
CPC ..... *G03G 15/0266* (2013.01); *G03G 15/1675* (2013.01); *G03G 21/08* (2013.01); *G03G 21/203* (2013.01)

(58) Field of Classification Search
CPC ..... G03G 15/0266; G03G 15/1675
See application file for complete search history.

(56) References Cited

U.S. PATENT DOCUMENTS 6,332,064 B1 * 12/2001 Sato ..... G03G 15/0216 399/128
7,403,727 B2 7/2008 Fujimori et al.
(Continued)

FOREIGN PATENT DOCUMENTS

JP S6195372 A 5/1986
JP H02134258 A 5/1990
(Continued)

OTHER PUBLICATIONS

Copending U.S. Appl. No. 15/221,923, filed Jul. 28, 2016.
Quayle Action issued in U.S. Appl. No. 15/221,923 mailed Apr. 10, 2017.

*Primary Examiner* — Walter L Lindsay, Jr.
*Assistant Examiner* — Arlene Heredia Ocasio
(74) *Attorney, Agent, or Firm* — Rossi, Kimms & McDowell LLP

(57) ABSTRACT

An image forming apparatus includes an acquiring portion that acquires a duration of an overcharged state occurring in an area of an image bearing body charged by a charging member after the image bearing body is exposed by a preliminary exposing portion. Adjustment is made to an interval between a first timing when the preliminary exposing portion starts exposing the image bearing body before execution of an adjustment operation for setting a transfer voltage value and a second timing when a voltage applying portion starts, during the subsequent adjustment operation, applying a voltage with an adjustment voltage value to a transfer member such that the second timing is later than a third timing when the duration acquired by the acquiring portion ends.

21 Claims, 14 Drawing Sheets

(51) Int. Cl.

| | |
|---|---|
| ***G03G 15/16*** | (2006.01) |
| ***G03G 21/08*** | (2006.01) |
| *G03G 21/20* | (2006.01) |

(56) References Cited

U.S. PATENT DOCUMENTS

| | | | | |
|---|---|---|---|---|
| 7,580,654 | B2 | 8/2009 | Okubo | |
| 8,041,244 | B2 | 10/2011 | Kojima | |
| 8,718,505 | B2 * | 5/2014 | Sakata | G03G 15/02 399/168 |
| 9,256,166 | B2 * | 2/2016 | Nakaegawa | G03G 15/1605 |
| 2009/0022517 | A1 | 1/2009 | Kanai et al. | |
| 2010/0021193 | A1 * | 1/2010 | Kojima | G03G 15/1605 399/66 |
| 2010/0086321 | A1 * | 4/2010 | Burry | G03G 21/203 399/44 |
| 2013/0308964 | A1 | 11/2013 | Adachi et al. | |
| 2014/0178086 | A1 | 6/2014 | Kitamura et al. | |
| 2014/0178087 | A1 | 6/2014 | Suzuki et al. | |
| 2016/0195837 | A1 * | 7/2016 | Matsuura | G03G 15/1675 399/66 |
| 2016/0334739 | A1 * | 11/2016 | Ohsugi | G03G 15/1605 |
| 2017/0031258 | A1 * | 2/2017 | Agata | G03G 15/0266 |

FOREIGN PATENT DOCUMENTS

| | | | |
|---|---|---|---|
| JP | H07301971 | A | 11/1995 |
| JP | 2002318519 | A | 10/2002 |
| JP | 2003114554 | A | 4/2003 |
| JP | 2005165217 | A | 6/2005 |
| JP | 2006133333 | A | 5/2006 |
| JP | 2007065389 | A | 3/2007 |
| JP | 2007094387 | A | 4/2007 |
| JP | 2009042738 | A | 2/2009 |
| JP | 2010026442 | A | 2/2010 |

* cited by examiner

ABNORMAL DISCHARGE HAS OCCURRED

NO ABNORMAL DISCHARGE

IMAGE FORMING APPARATUS ACQUIRING A DURATION OF OVERCHARGE

BACKGROUND OF THE INVENTION

Field of the Invention

The present invention relates to an image forming apparatus that forms an image on a recording material using an electrophotographic scheme.

Description of the Related Art

Conventionally available electrophotographic image forming apparatuses include electrophotographic copiers, electrophotographic printers (LED printers, laser beam printers, and the like), and electrophotographic facsimile machines. In these image forming apparatuses, a surface of an electrophotographic photosensitive member (hereinafter referred to as a photosensitive drum or a drum) is uniformly charged using a primary charger and the charged photosensitive drum surface is exposed using an exposure apparatus, thereby forming an electrostatic latent image. The electrostatic latent image is developed using a developing apparatus to form a developer image (hereinafter referred to as a toner image). The toner image is transferred to a recording material, such as a sheet, using a transfer apparatus. Subsequently, the toner image is fixed on the recording material as a fixed image using a fixing apparatus, and the fixed image is then output. Thereafter, the photosensitive drum is cleaned by a cleaning apparatus removing the toner having remained on the surface of the photosensitive drum after the transfer of the toner image, and thus the image forming apparatus is prepared for the next image forming operation.

In recent years, more and more image forming apparatuses have incorporated a charging apparatus employing contact charging, and such contact charging apparatuses have become prevailing. Most of the contact charging apparatuses use a conductive roller as a contact charging member and employ roller charging in which a voltage is applied by bringing the conductive roller into contact with the photosensitive drum. Two charging schemes are available; one of the schemes is a direct-current scheme in which the photosensitive drum surface is charged by applying only a direct-current voltage to the contact charging member, and the other scheme is an alternating-current superimposition scheme in which the photosensitive drum surface is charged by superimposing an alternating-current voltage on a direct-current voltage and applying the resultant current to the contact charging member. The alternating-current superimposition scheme has an advantage in uniformly charging the photosensitive drum surface. However, in the alternating-current superimposition scheme, discharge occurs frequently in accordance with the frequency of an alternating-current voltage, causing damage to the photosensitive drum surface and an increase in the amount by which the photosensitive drum surface is scraped off. This shortens the life of the photosensitive drum. In contrast, in the direct-current scheme, discharge in fine gaps occurs less frequently than in the alternating-current superimposition scheme, causing less damage to the photosensitive drum, which results in a longer life of the photosensitive drum.

Meanwhile, a conventionally known transfer step by the image forming apparatus involves bringing a transfer member such as a transfer roller into abutting contact with the photosensitive drum to form a transfer nip. Specifically, the toner image on the photosensitive drum is transferred to the recording material by applying a transfer bias to the transfer member while passing a recording material or an intermediate transfer member through the transfer nip. Resistance of the transfer member used in the transfer step is known to fluctuate according to the temperature and humidity of an atmospheric environment or over a long period of use. To allow high transferability to be constantly achieved in spite of the fluctuations in resistance, Japanese Patent Application Laid-open No. 2010-26442 proposes constant-voltage control based on active transfer voltage control (ATVC). Specifically, before image formation is started, a voltage with a predetermined value is applied to the transfer member, and a current output current value is sensed. Based on the applied voltage and the sensed current value, the value of the resistance between the transfer member and the photosensitive member is determined. Then, in accordance with the result of the determination, the value of the transfer voltage applied to the transfer member during subsequent image formation is adjusted.

In this ATVC, a slight variation in photosensitive drum potential affects the sensed voltage, and thus, the photosensitive drum surface needs to maintain a uniform potential during detection. Normally, this is performed where the potential of the photosensitive drum is a dark potential (Vd). The Vd potential portion is used because if a photosensitive layer in a photosensitive member surface is strongly charged to a polarity opposite to a regular polarity (in the present embodiment, a negative polarity) using the transfer member, a memory with an opposite polarity (referred to as a plus memory) is formed in the photosensitive layer surface, which may thus be damaged. The likelihood of the photosensitive layer surface being damaged increases with decreasing potential on the photosensitive member, i.e. The photosensitive layer surface is likely to be damaged at an exposure potential VL. However, residual charge in the last formed image pattern may vary the drum potential of the charged photosensitive drum, reducing the accuracy of the ATVC. Thus, a method may have been used in which the surface of the photosensitive drum is uniformly irradiated with light from a pre-charge exposure apparatus having a light source such as LEDs to make the potential of the photosensitive drum uniform before charging. This prevents a possible variation in the drum potential of the charged photosensitive drum.

However, there has been an increasing demand for an extended life of the photosensitive drum in order to reduce running costs of the image forming apparatus. The direct-current scheme advantageously reduces the amount by which the photosensitive drum surface is scraped off. However, the photosensitive drum surface is also degraded by discharge, and is scraped off as a result of passage of sheets or abutting contact with a cleaning member. The film thickness of the photosensitive drum thus decreases steadily. Furthermore, the pre-charge exposure makes the drum potential uniform to improve the accuracy of the ATVC, but reduces a surface potential of the uncharged photosensitive drum. This increases the amount of discharge and thus the amount by which the photosensitive drum surface is scraped off.

To avoid this problem, the initial film thickness of the photosensitive drum may be increased and the preliminary exposing or pre-exposure may be carried out immediately before execution of the ATVC, in order to minimize an irradiation time for the pre-charge exposure. However, abnormal discharge may conventionally occur when an area subjected to the pre-charge exposure is charged, resulting in a non-uniform potential of the charged drum to reduce the accuracy of the ATVC. This feature is conspicuous when the initial film thickness of the drum is increased in order to extend the life of the photosensitive drum.

SUMMARY OF THE INVENTION

An object of the present invention is to provide an image forming apparatus with which an extended life can be achieved without reducing the accuracy of ATVC.

In order to achieve above object, the present invention provides an image forming apparatus comprising:

an image bearing body that bears a developer image transferred to a recording material;

a charging member that charges the image bearing body;

a transfer member that transfers a developer image formed by development, using a developer, of an electrostatic image formed by exposure of the charged image bearing body, from the image bearing body to a transferred body;

a voltage applying portion that applies a voltage to each of the charging member and the transfer member;

a current detecting portion that detects a current flowing through the transfer member;

a preliminary exposing portion that exposes the image bearing body after the developer image is transferred and before the image bearing body is charged by the charging member;

a setting portion that sets a value of a transfer voltage applied to the transfer member by the voltage applying portion during image formation; and an acquiring portion is provided which acquires a duration of an overcharged state occurring in an area of the image bearing body charged by the charging member after the image bearing body is exposed by the preliminary exposing portion, wherein an adjustment operation being performed before image formation is started and after the charging member charges the image bearing body, the adjustment operation involving the voltage applying portion applying a voltage with a predetermined adjustment voltage value to the transfer member and the setting portion setting the transfer voltage value based on a current value detected by the current detecting portion when the voltage applying portion applies the voltage, and wherein adjustment is made to an interval between a first timing when the preliminary exposing portion starts exposing the image bearing body before execution of the adjustment operation and a second timing when the voltage applying portion starts, during the subsequent adjustment operation, applying the voltage with the adjustment voltage value to the transfer member such that the second timing is later than a third timing when the duration acquired by the acquiring portion ends.

Further features of the present invention will become apparent from the following description of exemplary embodiments (with reference to the attached drawings).

DESCRIPTION OF THE EMBODIMENTS

A mode for implementing the present invention will now be exemplary described in detail based on practical examples with reference to the drawings. It is to be understood that dimensions, materials, shapes, relative arrangements, and the like of components described in the embodiment are intended to be changed as deemed appropriate in accordance with configurations and various conditions of apparatuses to which the present invention is to be applied. In other words, the scope of the present invention is not intended to be limited to the embodiment described below.

Embodiment 1

<General Configuration of the Image Forming Apparatus>

Figure 1:
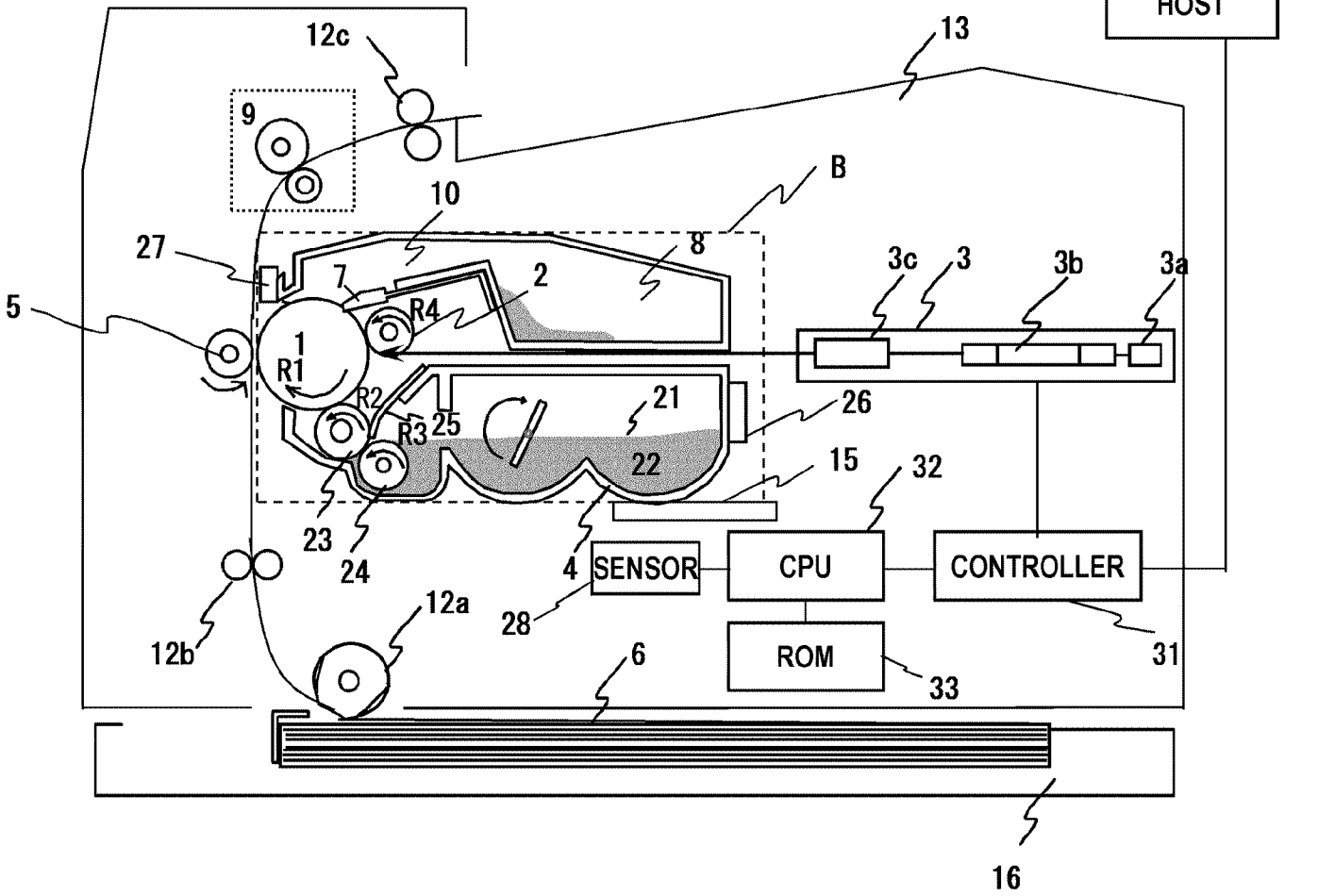
FIG. 1 is a sectional view depicting a general configuration of an image forming apparatus according to an embodiment of the present invention.
Figure 2:
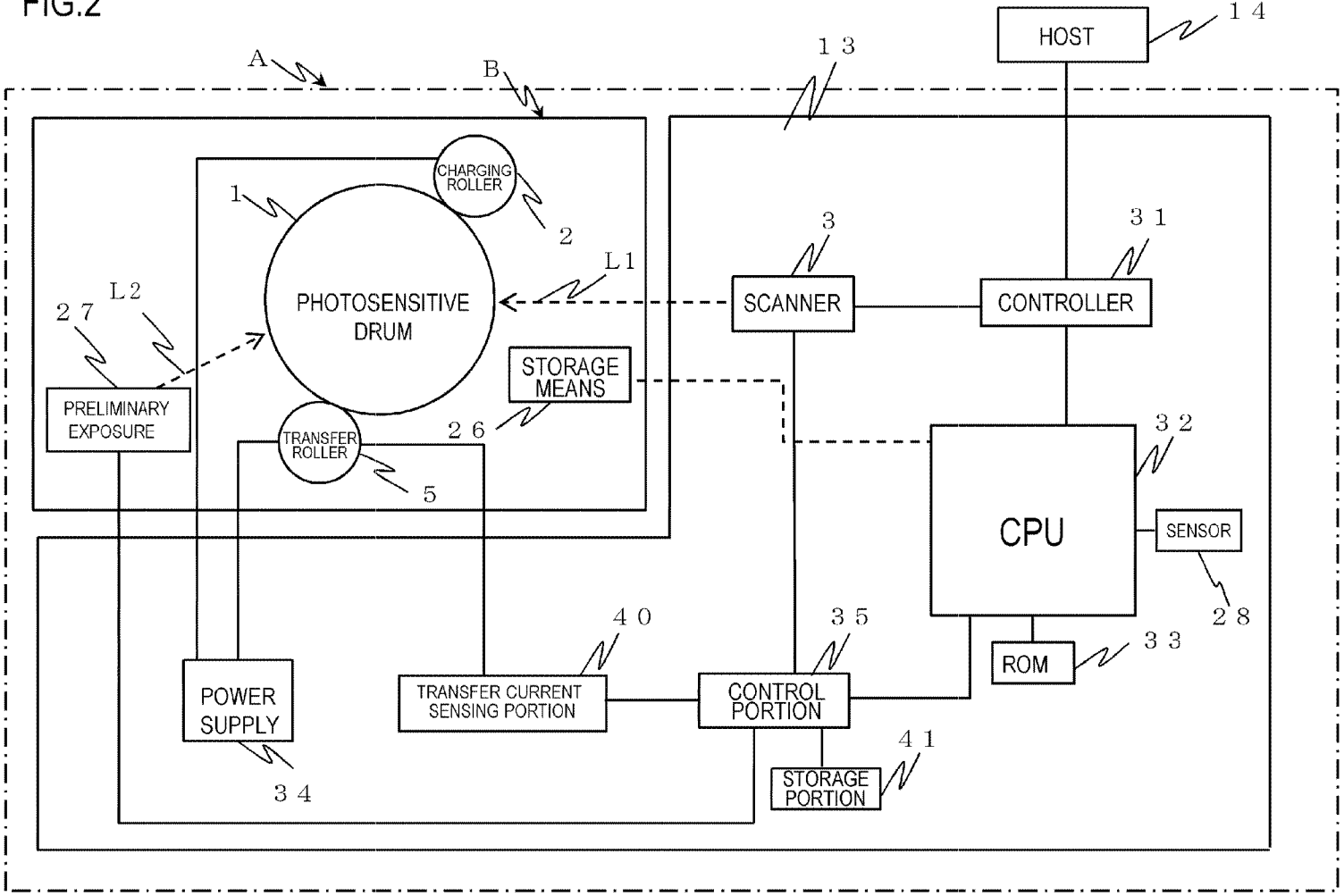
FIG. 2 is a control block diagram of the image forming apparatus according to the embodiment of the present invention.

A general configuration of an image forming apparatus according to an embodiment of the present invention will be described with reference to FIGS. 1 and 2. FIG. 1 is a schematic diagram depicting a general configuration of the image forming apparatus according to the embodiment of the present invention. FIG. 2 is a control block diagram of the image forming apparatus according to the embodiment of the present invention. An example of an image forming apparatus A in the present embodiment is a laser beam printer that forms an image on a recording medium (recording material) 6, for example, a recording sheet or an OH sheet, in accordance with image information based on an electrophotographic scheme. In the image forming apparatus A in the present embodiment, a process cartridge B is removable from an apparatus main body of the image forming apparatus A as described below in detail. The apparatus main body refers to the components of the image forming apparatus A except the process cartridge B. In the present embodiment, the image forming apparatus will be described which is configured to transfer a toner image (developer image) formed on a photosensitive drum directly to a recording material serving as a transferred body. However, the configuration of the image forming apparatus is not particularly limited. For example, the present invention is applicable to an image forming apparatus (such as a color laser printer) that transfers, in a superimposed manner, toner images in different colors formed using a plurality of image forming portions to an intermediate transfer member serving as a transferred body to form a color toner image, the image forming apparatus then transferring the toner image to a recording material.

The image forming apparatus A is connected to a host 14 such as a personal computer for use. A controller portion 31 processes a print signal (a print request signal and image data) from the host 14 and controls a scanner 3 serving as exposure means to form an electrostatic latent image (electrostatic image) on a photosensitive drum 1. In other words, the image forming apparatus A forms an image on a recording material based on a print signal. The image forming apparatus A has the photosensitive drum 1 that is cylindrically shaped and rotationally driven in a direction of arrow R1 in FIG. 1 and that serves as an image bearing body (rotating body). In the present embodiment, the photosensitive drum 1 is an electrophotographic photosensitive member including an aluminum cylinder that is a cylindrical substrate around which an organic photo conductor (OPC) layer with a film thickness of 24 μm is applied as a photosensitive layer. The photosensitive drum 1 has a minimum photosensitive-member film thickness of 9 μm at which appropriate image quality can be maintained. The life of the photosensitive member ends when the minimum photosensitive-member film thickness is reached. A charging position refers to a contact portion between a charging roller 2 and the photosensitive drum 1 in a circumferential direction of a circular surface of the photosensitive drum 1 as viewed in an axial direction thereof.

The photosensitive drum 1 is uniformly charged by a roller-like charging member that is charging means (first exposing unit) and that is pressurized and brought into abutting contact with the photosensitive drum 1, that is, a DC contact charging roller (charging roller) 2. In the present embodiment, the charging roller 2 includes a cored bar and a conductive rubber layer provided on the cored bar. In the present embodiment, as described below in detail, a direct-current voltage fixed to a predetermined value so as to serve as a charging bias is applied from a power supply 34 to the charging roller 2 to negatively charge the surface of the photosensitive drum 1 in a uniform manner. The charging roller 2 rotates in a direction of arrow R4 in FIG. 1 in conjunction with rotation of the photosensitive drum 1. The charging roller 2 is in abutting contact with the photosensitive drum 1 substantially all along a longitudinal direction (a direction orthogonal to a conveying direction of a recording medium 6).

The uniformly charged photosensitive drum 1 is exposed to laser light L1 from a scanner 3 serving as exposure means, to form an electrostatic latent image on the surface of the photosensitive drum 1. The scanner 3 has a laser light source 3*a*, a polygon mirror 3*b*, and a lens system 3*c* and can scan and expose the surface of the photosensitive drum 1 under the control of the controller portion 31. Latent image settings in the present embodiment are Vd=−500V and V1=−100V regardless of the photosensitive member film thickness. An exposure position refers to a position on the photosensitive drum 1 that is irradiated with the laser light L1 in the circumferential direction of the circular surface of the photosensitive drum 1 as viewed in the axial direction thereof.

Subsequently, a developer is applied to the electrostatic latent image by a developing apparatus 4 to visualize the electrostatic latent image into a toner image. In other words, the developing apparatus 4 has a developing container 21 that houses negative-charge type nonmagnetic toner (toner) 22 as a one-component developer. In the present embodiment, the toner 22 is generally spherical toner with a weight average particle size of approximately 7 82 m in order to achieve a reduced particle size and a lowered melting point and to improve transfer efficiency.

A part of the developing container 21 that faces the photosensitive drum 1 is open substantially all along a longitudinal direction of the photosensitive drum 1. In this opening, a developing roller 23 is arranged which is a roller-like developer bearer (developing means). The developing roller 23 is pressed and brought into contact with the photosensitive drum 1, located at an upper left position with respect to the developing apparatus 4 in FIG. 1, such that the developing roller 23 bites into the photosensitive drum 1 by a predetermined amount. The developing roller 23 is rotationally driven in a direction of arrow R2 in FIG. 1. A surface of the developing roller 23 has appropriate recesses and protrusions to increase the probability of frictional sliding between the developing roller 23 and the toner 22 and to allow the toner 22 to be appropriately conveyed.

An elastic roller 24 is located at a lower right position with respect to the developing roller 23 in FIG. 1 in abutting contact with the developing roller 23. The elastic roller 24 serves as means for supplying a developer to the developing roller 23 and stripping undeveloped toner from the developing roller 23. The elastic roller 24 is rotatably supported by the developing container 21. The elastic roller 24 is a rubber sponge roller that allows the toner to be appropriately supplied to the developing roller 23 and that allows the undeveloped toner to be appropriately stripped. The elastic roller 24 is rotationally driven in a direction of arrow R3 that is the same direction as that in which the developing roller 23 is rotationally driven. The developing apparatus 4 includes a developing blade 25 as a developer layer thickness regulating member that regulates the amount of toner borne by the developing roller 23. The developing blade 25 includes a thin metal plate formed of SUS, which is elastic, and comes into abutting surface contact with an outer peripheral surface of the developing roller 23 at a vicinity of a tip of a free end of the developing blade 25. Toner borne on the developing roller 23 due to frictional sliding between the developing roller 23 and the elastic roller 24 is charged by triboelectric charging and formed into a thin layer in a regulatory manner upon passing through the abutting contact portion between the developing roller 23 and the developing blade 25.

In the developing apparatus 4 configured as described above, a direct-current voltage fixed to a predetermined value so as to serve as a developing bias is applied to the developing roller 23. In the present embodiment, the developing bias is uniformly set to Vdc=−300 V regardless of the photosensitive member film thickness. Consequently, in the present embodiment, an exposed portion of the uniformly charged surface of the photosensitive drum 1 that has attenuated negative charge is developed based on reversal development. A developing position refers to a contact portion between the developing roller 23 and the photosensitive drum 1 in the circumferential direction of the circular surface of the photosensitive drum. 1 as viewed in the axial direction thereof.

On the other hand, the recording medium 6 is separated and fed from a recording medium housing portion 16 by a supply roller 12*a* and the like and temporarily stops at a registration roller 12*b*. The registration roller 12*b* synchronizes a recording position of the recording medium 6 with a timing when the toner image is formed on the photosensitive drum 1 and feeds the recording medium 6 to a facing portion (transfer portion) where a transfer roller 5 that is transfer means faces the photosensitive drum 1. The visualized toner image on the photosensitive drum 1 is transferred to the recording medium 6 by the action of the transfer roller 5. In the present embodiment, a control portion 35 enables a transfer voltage for image formation to be set based on a sensing result from a current detecting portion 40 that detects a transfer current. The control portion 35 also has a storage portion 41 that stores information used to control an image forming operation based on stored information. A transfer position refers to a contact portion between the transfer roller 5 and the photosensitive drum 1 in the circumferential direction of the circular surface of the photosensitive drum 1 as viewed in the axial direction thereof.

The recording medium 6 with the toner image transferred thereto is conveyed to a fixing apparatus 9. Then, the toner image on the recording medium 6, which is unfixed, is permanently fixed to the recording medium 6 by heat or pressure. Subsequently, the recording medium 6 is discharged from the image forming apparatus by a discharge roller 12*c* and the like.

On the other hand, the photosensitive drum 1, from which the toner image has been transferred to the recording medium 6, is entirely exposed to (entirely irradiated with) laser light L2 emitted by a preliminary exposing apparatus or pre-exposure apparatus (second exposing unit) 27 that is pre-exposure means. Consequently, the potential of the photosensitive drum surface, which has been non-uniform due to the last formed image, is made uniform. That is, the photosensitive drum surface is irradiated with light so as to remove residual charge from the photosensitive drum surface. The pre-exposure apparatus 27 (preliminary exposing portion) is disposed on a downstream side with respect to the transfer roller 5 in a photosensitive drum rotating direction and on an upstream side with respect to the charging roller 2 in the photosensitive drum rotating direction. The pre-exposure apparatus 27 exposes the photosensitive drum surface after passing by the transfer position and before reaching the charging position. As a light source for the pre-exposure means, an LED, a halogen lamp, or the like can be used. The light source used is not particularly limited. However, the LED is preferably used because the LED needs only a low driving voltage and allows the apparatus to be easily miniaturized. In the present embodiment, the LED is used as a pre-exposure light source. Operations of the pre-exposure apparatus 27 are controlled by the control portion 35. A pre-exposure position refers to a portion of the photosensitive drum 1 that is irradiated with light from the pre-exposure apparatus 27 in the circumferential direction of the circular surface of the photosensitive drum 1 as viewed in the axial direction thereof.

Transfer residual toner remaining on the photosensitive drum 1 without being transferred is cleaned by cleaning means (cleaner) 10. In other words, the cleaner 10 scrapes the transfer residual toner off from the photosensitive drum 1 using a cleaning blade 7 that is a cleaning member, and places the transfer residual toner in a waste toner container 8. The cleaned photosensitive drum 1 is repeatedly used for image formation as described above.

In the present embodiment, the image forming apparatus A is based on a process cartridge scheme in which an electrophotographic photosensitive member serving as an image bearing body and process means acting on the image bearing body are integrated into a cartridge that is removable from an apparatus main body. The process means includes the charging means for charging the electrophotographic photosensitive member, the developing means for supplying a developer to the electrophotographic photosensitive member, and the cleaning means for cleaning the electrophotographic photosensitive member. In other words, the process cartridge is configured as follows. The charging means, the developing means, and the cleaning means, and the electrophotographic photosensitive member are integrated into a cartridge that is removable from the apparatus main body. Alternatively, at least one of the charging means, the developing means, and the cleaning means, and the electrophotographic photosensitive member are integrated into a cartridge that is removable from the apparatus main body. Alternatively, at least the developing means and the electrophotographic photosensitive member are integrated into a cartridge that is removable from the apparatus main body.

In the present embodiment, the photosensitive drum 1, the charging roller 2, the developing apparatus 4, and the cleaner 10 are integrated into a process cartridge B that is removable from an apparatus main body 13. The process cartridge B is removably installed in the apparatus main body 13 via installation means 15 provided in the apparatus main body 13. The recording medium supply roller 12*a*, the registration roller 12*b*, and the discharge roller 12*c*, and the like described above form recording medium conveying means for conveying the recording medium 6 to the process cartridge B and discharging the recording medium 6 with an image formed thereon from the apparatus main body 13.

In the present embodiment, the process cartridge B is provided with storage means 26 (storage portion). The storage means 26 may be in any form, for example, a contact nonvolatile memory, a non-contact nonvolatile memory, or a volatile memory with a power supply. In the present embodiment, a non-contact nonvolatile memory 26 is mounted in the process cartridge B as storage means. The non-contact nonvolatile memory 26 has an antenna (not depicted in the drawings) that is information communicating means on a memory side. The non-contact nonvolatile memory 26 enables information to be written thereto and read therefrom by wirelessly communicating with control means (CPU) 32 provided in the image forming apparatus main body 13. In the present embodiment, the CPU 32 includes functions of information communicating means on an apparatus main body side and means for writing and reading information to and from the memory 26. The storage means 26 stores information on the photosensitive member film thickness of the photosensitive drum 1 described below, information on the charging roller 2, and information on a use environment.

In the above-described configuration, components such as the power supply 34, the control portion (control unit) 35, and the CPU 32, which are related to the application of a voltage to the charging roller 2 and the transfer roller 5, correspond to a voltage applying portion in the present invention.

<Transfer Voltage Adjusting Operation>

A transfer voltage adjusting operation (hereinafter referred to as ATVC) in the present embodiment will be described. In the ATVC, the control portion 35 has the function of a setting portion to set a transfer voltage value.

The ATVC operation is performed while no image is being formed. The transfer roller 5 in the image forming apparatus includes a conductive urethane sponge. Such a conductive roller is difficult to suppress a variation in resistance during manufacturing, and the resistance varies due to a variation in the temperature or humidity of an atmospheric environment, degradation resulting from long-time use, or the like. In contrast, when a transfer bias is subjected to constant current control, the transfer voltage may be fluctuated by, for example, a printing ratio for an image to be transferred, preventing optimum transfer. Thus, a method referred to as the ATVC is used to avoid this problem.

Input of an image formation signal allows rotation of the photosensitive drum 1 to be started. The control portion 35 performs the ATVC operation at a preset timing with respect to the input of the image formation signal based on an ATVC start signal. First, for application of a charging voltage, the control portion 35 applies a voltage to the charging roller 2 to form a drum potential Vd. To provide the same voltage Vd as that which is applied during image formation, conditions for the voltage applied to the charging roller 2 are set the same as the conditions used during image formation. For uniform Vd, the uncharged photosensitive drum 1 is entirely exposed (entirely irradiated with light) by the pre-exposure apparatus 27, which is the pre-exposure means, to make uniform the potential of the photosensitive drum surface that has been made non-uniform during the last image formation. That is, the photosensitive drum surface is irradiated with light so as to remove residual charge from the photosensitive drum surface. The pre-exposure apparatus 27 is disposed on the downstream side with respect to the transfer roller 5 in the photosensitive drum rotating direction and on the upstream side with respect to the charging roller 2 in the photosensitive drum rotating direction.

Figure 3:
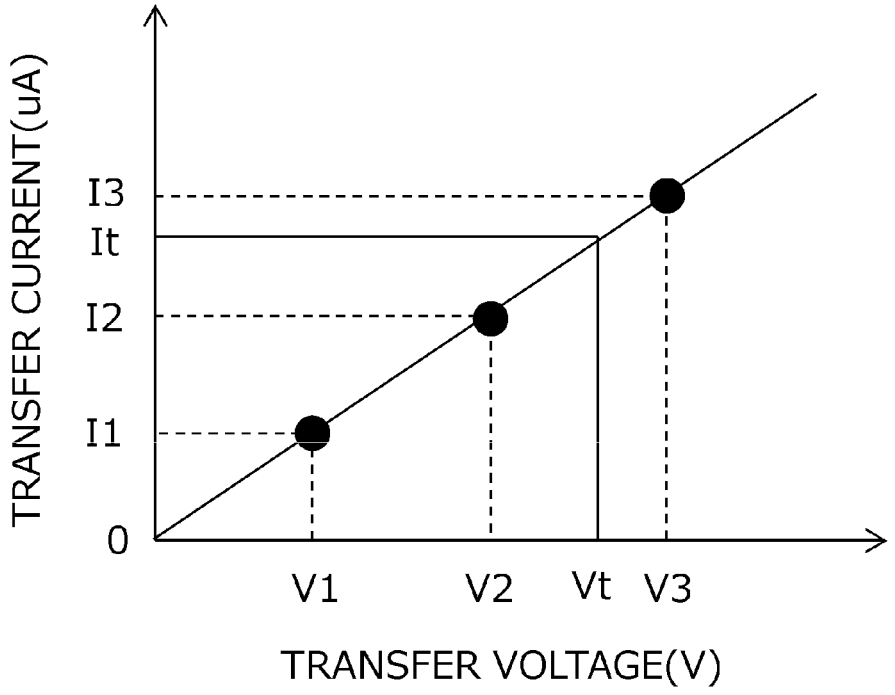
FIG. 3 is a schematic diagram illustrating ATVC in the embodiment of the present invention.

When an area with the drum potential Vd formed thereon passes by the transfer position, power supplied by the power supply 34 is applied to the transfer roller 5 at preset adjustment voltage values V1, V2, and V3. A current detecting portion 40 senses resultant output current values Il (when V1 is applied), 12 (when V2 is applied), and 13 (when V3 is applied). Based on these results, a relation illustrated in FIG. 3 is determined. Based on FIG. 3, a calculated voltage value Vt is calculated which allows a preset target current value It to be obtained. FIG. 3 is a diagram illustrating the ATVC in the present embodiment. The target current value corresponds to a voltage to be applied to the transfer roller 5 during image formation and can be varied in accordance with an image formation state resulting from an environmental fluctuation. The calculated transfer voltage value Vt is stored in the storage portion 41 so that the voltage of the transfer voltage value Vt can be applied during image formation.

In the present embodiment, the ATVC operation is performed under the following conditions.

Pre-rotation for each execution of a JOB (pre-rotation performed at the beginning of an image forming operation sequence executed in accordance with an image formation command (a preparing operation for adjusting the components before image formation is performed))

Distance between sheets during a consecutive JOB (during sequential execution of a plurality of image formation commands, a distance between a recording material on which an image is formed in accordance with the last image formation command and a recording material on which an image is formed in accordance with the subsequent image formation command.)

A target current value It is preset in the image forming apparatus as a current value at which appropriate transferrability is achieved.

An optimum current value is normally obtained by voltage adjustment for a solid white portion (on-drum potential: Vd). A difference in potential between a solid white potential Vd and a solid black potential V1 (Vd−V1) is set to a given value under predetermined image formation conditions. Thus, a current flowing into a solid black portion can be predicted. Therefore, performing the ATVC (on Vd) for the solid white portion enables a desired current value to be achieved for a current in a solid portion (V1 portion).

<Abnormal Discharge Phenomenon>

Abnormal discharge is a phenomenon in which, when a direct-current voltage is applied to the charging roller 2, the charging potential becomes excessive as a result of overdischarge occurring in a long gap portion; to explain this long gap portion, a gap portion where normal discharge occurs is located on an upstream side, in the photosensitive drum rotating direction, with respect to a nip defined by the charging roller 2, whereas the long gap portion is located further on an upstream side, in the photosensitive drum rotating direction, with respect to the gap portion and has a larger gap than the gap portion. In the long gap portion, ramping up the charging bias applied to the charging roller dramatically changes normal discharge that is faint and temporally continuous into intermittent discharge that involves a large discharge current and that is both temporally and spatially discontinuous. The abnormal discharge is considered to be classified as Townsend discharge occurring during normal discharge. The Townsend discharge is a discharge phenomenon that varies according to electric fields between electrodes and the type of a gas, the pressure of the gas, and an electrode material.

A proximity discharge phenomenon in the air occurs according to the Paschen's law. This is an electron avalanche diffusion phenomenon in which the following process is repeated: freed electrons are accelerated by electric fields, and collide against molecules present between electrodes and the electrodes to generate electrons, positive ions, and negative ions. The electron avalanche diffuses according to electric fields, and the diffusion determines the final amount of discharge. Conditions for electric fields that are excessive compared to conditions according to the Paschen's law make locally intense discharge, that is, the abnormal discharge, likely to occur. An overcharged area of the photosensitive drum 1 charged by the abnormal discharge (overcharge) has been charged by the charging roller 2, through which a charging current with a value equal to or larger than a desired value has flowed.

The abnormal discharge phenomenon is likely to occur under the following conditions. Compared to a condition at a normal temperature and at a normal humidity, a condition at a lower temperature and at a lower humidity involves fewer molecules between the electrodes and thus tends to involve a discharge start voltage that is higher than the discharge start voltage derived based on the Paschen's law. An increased discharge start voltage is likely to involve conditions for electric fields that are excessive compared to the conditions according to the Paschen's law, making the abnormal discharge likely to occur at a low temperature and at a low humidity.

The likelihood of the abnormal discharge increases consistently with the film thickness of the photosensitive drum 1. The increased film thickness reduces capacitance and thus the amount of charge Q needed for the desired charging voltage Vd. The charging potential of the photosensitive drum 1 is estimated to be become excessive as follows when ionization caused by collision of electrons occurs like an avalanche as described above. The ionization causes an exponential increase in the number of charged particles. Then, the air is dielectrically broken down to cause a large current to flow at a stretch. Amore amount of charge than needed is thus collected on the photosensitive drum 1. In addition, through earnest examinations, the inventors have found that the abnormal discharge is likely to occur when the photosensitive layer (OPC layer) has a film thickness of more than 21 μm and is more likely to occur when the film thickness is equal to or larger than 22 μm The abnormal discharge is also likely to occur when the charging roller 2 offers low resistance. When a discharge current flows through a roller offering low resistance, the roller has a relatively lower assigned voltage than a roller offering high resistance. The roller has a reduced assigned voltage to relatively increase a voltage assigned to an air layer (gap portion). This in turn increases a discharge current flowing through the roller to the photosensitive drum 1 compared to a discharge current flowing through the roller with high resistance to the photosensitive drum 1. Therefore, the roller with low resistance is expected to have a lower abnormal-discharge start voltage and to be more likely to undergo the abnormal discharge, than the roller with high resistance. In other words, the abnormal discharge depends on the charging capability of the charging roller 2.

In some cases the abnormal discharge is likely to be caused by a change in the surface potential of the photosensitive drum 1 before and after the charge by the charging roller 2. Specifically, when a significant difference is present between the surface potential of the photosensitive drum 1 obtained immediately before the photosensitive drum 1 is charged by the charging roller 2 (hereinafter referred to as the pre-charge potential) and the surface potential of the photosensitive drum 1 obtained immediately after the photosensitive drum 1 is charged by the charging roller 2, electric fields in the air layer (gap portion) are intensified to increase the amount of discharge current in the air layer, making the abnormal discharge likely to occur in the air layer. The preliminary exposing apparatus or pre-exposure apparatus 27 exposes the entire photosensitive drum 1 surface before the photosensitive drum 1 is charged by the charging roller 2 in order to make uniform the potential of the photosensitive drum 1 surface made non-uniform during the last image formation. Thus, a configuration with pre-exposure involves a greater difference between the pre-charge potential and the charging potential than a configuration without any pre-exposure.

The difference between the pre-charge potential and the charging potential (the surface potential of the photosensitive drum 1 obtained immediately after charging) increases consistently with the charging potential Vd. Thus, the likelihood of the abnormal discharge increases consistently with the charging bias applied to the charging roller 2.

<Occurrence of the Abnormal Discharge>

Figure 4A:
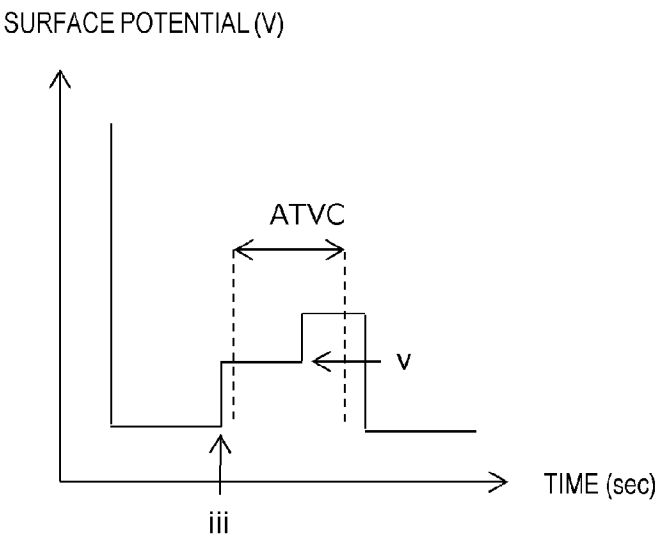
FIGS. 4A and 4B are diagrams illustrating time transition of a drum potential observed when abnormal discharge occurs.
Figure 4B:
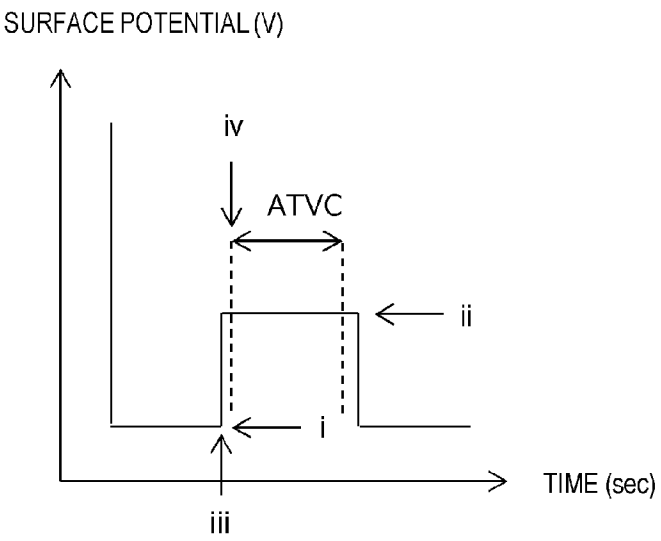

FIG. 4 illustrates time transition of the surface potential of the photosensitive drum 1 at the transfer position. FIG. 4A illustrates a state where the abnormal discharge is occurring, and FIG. 4B illustrates a state where no abnormal discharge is occurring. Input of a print signal allows a pre-rotation operation to be started, and the operation shifts to the ATVC. First, the photosensitive drum 1 rotates, and then the charging bias is applied to the photosensitive drum 1. A potential i is the charging potential of the photosensitive drum 1 to which the charging bias has been applied. A potential ii is the charging potential Vd of the photosensitive drum 1 exposed to light from the pre-exposure apparatus 27. A timing iii is a timing (first timing) when the irradiation from the pre-exposure apparatus 27 is started. A timing iv is a timing (second timing) when application of the transfer bias is started based on the ATVC. In other words, in the present embodiment, when image formation is performed based on the print signal, the photosensitive drum 1 is charged by applying the charging bias to the photosensitive drum 1, and the irradiation of the charged surface of the photosensitive drum 1 with light is started by the pre-exposure apparatus 27. Therefore, the timing iii when the pre-exposure apparatus 27 starts the irradiation determines the charging start timing when charging of the portion of the photosensitive drum 1 exposed by the pre-exposure apparatus 27 is started by the charging roller 2. In other words, the charging start timing corresponds to the timing iii plus the period of time from the pre-exposure until the charging when a predetermined point on the surface of the photosensitive drum 1 moves from the pre-exposure position to the charging position. The period between pre-exposure and charging has a value determined by the rotation speed of the photosensitive drum 1.

In the present embodiment, to extend the life of the image forming apparatus, the irradiation is started by the pre-exposure apparatus 27 immediately before the application of the transfer bias based on the ATVC in order to make the irradiation time of the pre-exposure apparatus 27 as short as possible. If the abnormal discharge occurs as illustrated in FIG. 4A, immediately after the irradiation is started by the pre-exposure apparatus 27, the pre-exposed area of the photosensitive drum 1 has a surface potential higher than Vd and is thus overcharged (V). Subsequently, the abnormal discharge converges over time, reducing the surface potential of the photosensitive drum 1 to the normal charging potential Vd.

Figure 5:
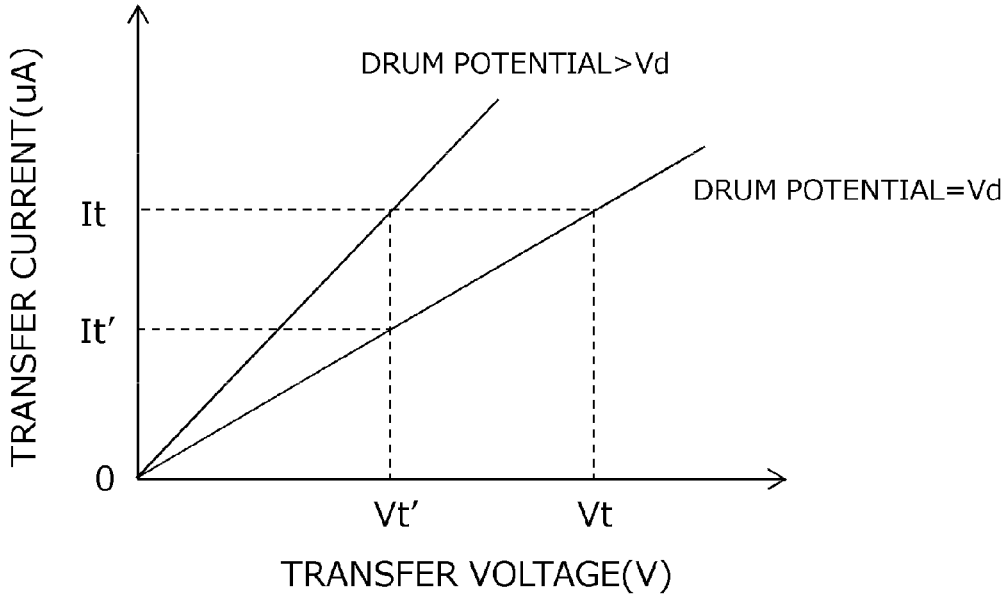
FIG. 5 is a diagram illustrating a relation between a transfer current and a transfer voltage.

FIG. 5 illustrates a relation between a transfer current and a transfer voltage. While the abnormal discharge is occurring, that is, while the drum potential is higher (has a larger absolute value) than the charging potential Vd (drum potential >Vd), the difference in potential between the transfer roller 5 and the photosensitive drum 1 increases to allow a current to flow more easily even at the same transfer voltage. In this state, the ATVC sets a transfer voltage Vt' lower than the value Vt calculated at the drum. potential Vd to be a control value for the target current value. As a result, a current flowing at the normal charging potential has a value It' smaller than the target value, leading to an insufficient current and thus inappropriate transfer.

Therefore, if the abnormal discharge occurs, possible inappropriate transfer can be prevented by starting the ATVC after recovery of the normal charging potential Vd following the end of the abnormal discharge. Inappropriate transfer can be avoided by uniformly increasing a pre-exposure lighting time during the ATVC sufficiently to prevent possible abnormal discharge. However, an extended pre-exposure time leads to trade-off with scrape-off of the drum surface. Thus, more specifically, the life of the image forming apparatus can be extended with inappropriate transfer prevented by sensing an abnormal-discharge period and advancing the start of irradiation from the pre-exposure apparatus 27 or delaying the start of the ATVC, only in the case of abnormal discharge.

<Method for Sensing the Abnormal-discharge period>

Now, a method for sensing the abnormal-discharge period (the duration of the abnormal discharge (overcharged state)) will be described. In the present embodiment, the abnormal-discharge period is calculated (acquired) using information on the film thickness of the photosensitive drum 1 and information on the use environment. In the present embodiment, a configuration for acquisition of the abnormal-discharge period corresponds to an acquiring portion in the present invention.

Figure 6:
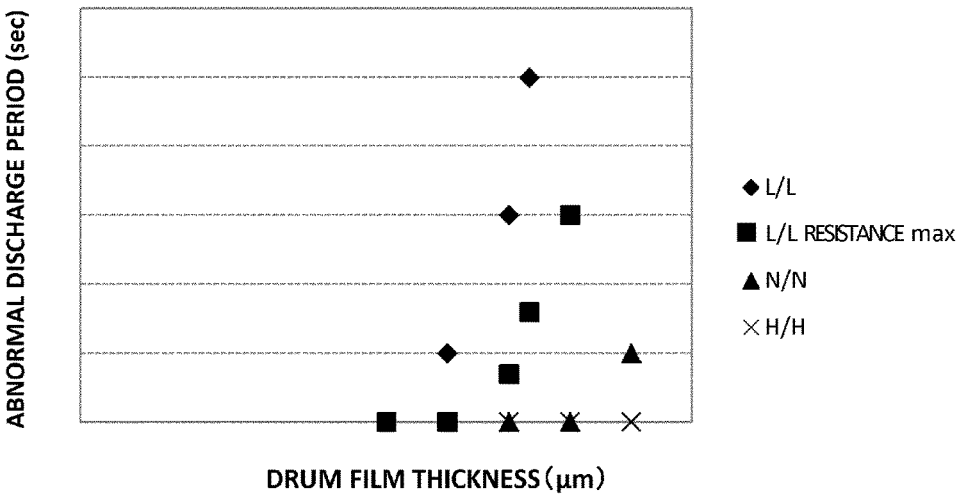
FIG. 6 is a diagram illustrating a correlation between a photosensitive member film thickness and an environment during an abnormal discharge period.

FIG. 6 is a graph illustrating how a maximum abnormal-discharge period varies according to the film thickness of the photosensitive drum 1 and the use environment (temperature and humidity). The charging potential Vd=−500 V. The graph indicates that no abnormal discharge occurs at a temperature of 30° C. and a humidity of 80% corresponding to a high-temperature and high-humidity environment (H/H), whereas the abnormal discharge occurs at a temperature of 15° C. and a humidity of 10% corresponding to a low-temperature and low-humidity environment (L/L). The graph also indicates that, in the low-temperature and low-humidity environment (L/L), an increased film thickness of the photosensitive drum 1 causes the abnormal discharge and that the abnormal-discharge period increases consistently with film thickness. The abnormal-discharge period also increases with decreasing resistance value of the charging roller 2.

Thus, based on these measurement data (the relation between the abnormal-discharge period and the film thickness of the photosensitive drum and the relation between the abnormal-discharge period and the use environment), an approximate curve that allows the abnormal-discharge period to be calculated is determined, and the corresponding data is pre-stored in the ROM 33 in the image forming apparatus main body. The resistance value of the charging roller 2 may slightly vary in connection with a manufacturing method for the charging roller 2, and thus, the present embodiment adopts results for a charging roller with the smallest one of varying resistance values. For the sensing of the abnormal-discharge period, the abnormal-discharge period can be calculated by adopting data on the approximate curve stored in the ROM 33 that corresponds to the information on the film thickness of the photosensitive drum 1 and the information on the temperature and humidity stored in the storage means 26. A method for determining the approximate curve may be any of statistical techniques such as linear approximation, exponential approximation, polynominal approximation, power approximation, and moving average approximation, and is not particularly restricted. Any optimum method may be used as needed.

<Information on the Film Thickness of the Photosensitive Drum 1 and Information on the Use Environment>

The information on the film thickness of the photosensitive drum I can be calculated as follows. As described above, the film thickness of the photosensitive member is reduced by degradation of the surface of the photosensitive drum 1 caused by discharge and by scrape-off of the surface of the photosensitive drum 1 as a result of passage of the recording medium 6 (passage of sheets) and abutting contact of the cleaning member 7 with the surface. In the image forming apparatus A in the present embodiment, the reduction in photosensitive member film thickness in the photosensitive drum 1 is correlated with a charging bias application time. The charging bias application time is proportional to the number of images formed. Therefore, the decrease rate of the photosensitive member film thickness in the photosensitive drum 1 can be represented as a linear function of the number of images formed.

The information on the use environment can be calculated as follows. The image forming apparatus A in the present embodiment includes an environment sensor (temperature humidity sensor) 28 provided in the apparatus main body and serving as environment sensing means. The environment sensor senses a temperature P and a humidity Q at predetermined time intervals to rewrite the information on the use environment in the storage means 26. In the present embodiment, the storage means 26 mounted in the process cartridge B stores the number of images formed (P) as the information on the photosensitive member film thickness and the temperature and humidity as the information on the use environment. The abnormal-discharge period is calculated by the above-described method using these two pieces of information to vary the time from the start of irradiation from the pre-exposure apparatus 27 until the start of the ATVC. The information on the photosensitive member film thickness include, besides the number of images formed, the rotation speed of the photosensitive drum 1, the number of sheets passed (the number of recording materials having passed through the image forming apparatus), and a charging time (charging bias application time). Any of these pieces of information may be selected.

<Method for Controlling the Time Interval between the Start of Irradiation from the Pre-exposure Apparatus and the Start of Exposure>

Figure 7:
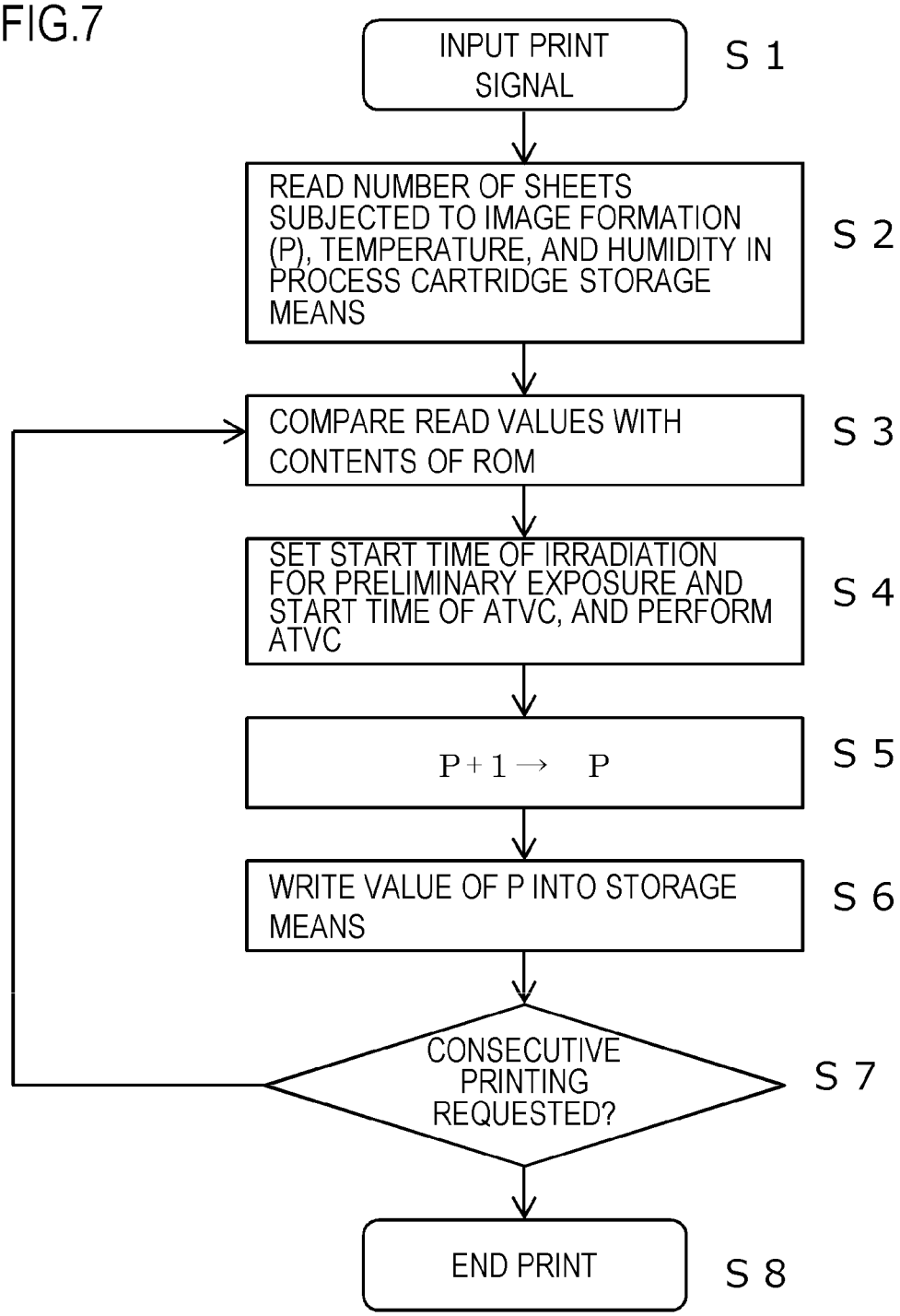
FIG. 7 is a flowchart of control for a pre-exposure start time in Embodiment 1 of the present invention.

With reference to a flowchart in FIG. 7, a method for varying the time between the start of irradiation from the pre-exposure apparatus 27 and the start of the ATVC will be described. The process cartridge B includes the storage means 26 that stores the number of images formed using the process cartridge B, the temperature, and the humidity. When the host 14 inputs the print signal to the image forming apparatus (S1), the CPU 32 communicates with the storage means 26 mounted in the process cartridge B to load the number of images formed (P) for the process cartridge B, the temperature, and the humidity (S2). Then, the CPU 32 compares the contents of the ROM 33 in the image forming apparatus main body, in which the abnormal-discharge period corresponding to the number of images formed, the temperature, and the humidity is pre-stored, with the number of images formed (P), the temperature, and the humidity loaded into the CPU 32 as described above. Then, the CPU 32 allows the control portion 35, which controls the time from the start of irradiation from the pre-exposure apparatus 27 until the start of the ATVC, to set the time from the start of irradiation from the pre-exposure apparatus 27 until the start of the ATVC and to shift to an image forming operation (S4).

Figure 8:
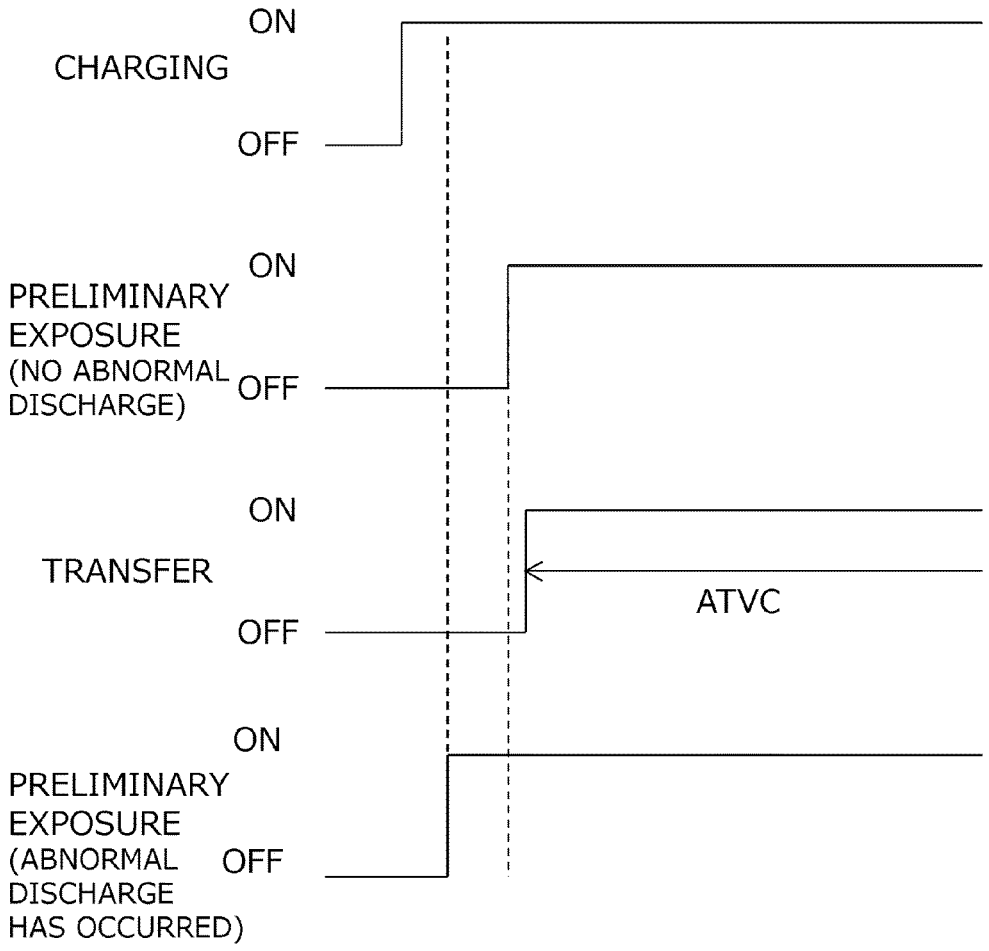
FIG. 8 is a timing chart of pre-exposure start in Embodiment 1 of the present invention.

FIG. 8 is a timing chart for the time from the start of irradiation from the pre-exposure apparatus 27 (first timing) until the start of the ATVC (second timing). When the image forming operation is started based on the reception of the print signal from the host 14, the photosensitive drum 1 rotates, and a predetermined charging bias is applied to the photosensitive drum 1. Subsequently, the pre-exposure apparatus 27 starts irradiation, and the ATVC is started. The start of the ATVC is specifically the start of application of the transfer bias for the ATVC. While no abnormal discharge is occurring, the pre-exposure apparatus 27 radiates light immediately before the start of the ATVC. While the abnormal discharge is occurring, the start time of the ATVC is fixed, the start of irradiation from the pre-exposure apparatus 27 is advanced by an amount of time equal to the abnormal-discharge period. That is, the timing for the start of irradiation from the pre-exposure apparatus 27 is varied such that the start time of the ATVC is later than a timing when the abnormal discharge ends (third timing). Consequently, the ATVC can be performed, instead of using an overcharged area of the surface of the photosensitive drum 1 that is charged by the abnormal discharge, on an area of the surface of the photosensitive drum 1 located, in a moving direction of the surface of the photosensitive drum 1, on the upstream side with respect to the overcharged area.

Varying the timing for the start of irradiation from the pre-exposure apparatus 27 is equal to varying the timing when the charging roller 2 first starts charging a portion of the photosensitive drum 1 exposed by the pre-exposure apparatus 27. Therefore, the control portion 35 controls the time of the start of irradiation from the pre-exposure apparatus 27 and the time of the start of the ATVC to control the period (first period) from the charging start timing when the charging roller 2 first starts charging a portion of the photosensitive drum 1 exposed by the pre-exposure apparatus 27 until the timing when the ATVC is started. When the control as described above is performed, the control unit sets the first period as follows. In other words, when the length of the abnormal-discharge period (second period) is denoted as T1, the control portion 35 is assumed to set the first period to be Δt1 so as to avoid performing the ATVC on the overcharged area. Then, when the length of the abnormal-discharge period (second period) is T2 longer than T1, the control portion 35 sets the first period to be Δt2 longer than Δt1 so as to avoid performing the ATVC on the overcharged area.

When the abnormal discharge occurs, the charging start timing when the charging roller 2 first starts charging a portion of the photosensitive drum 1 exposed by the pre-exposure apparatus 27 is equal to the timing when the abnormal discharge starts.

When the image forming operation ends, the count of the number of images formed is increased by one (S5), and the count of the number of images formed in the storage means 26 in the process cartridge B is rewritten (S6). Subsequently, the control portion 35 determines whether any request for consecutive printing has been received (S7). When no request has been received, the control portion 35 shifts to a print ending operation (S8). When any request has been received, the operations in S3 to S7 are repeated until no other request is found.

<Check of Effects>

To check the effects of the present embodiment, 50,000 images were formed using the image forming apparatus A in the present embodiment performing the above-described control and the image forming apparatuses in Comparative Examples 1 and 2 performing conventional control instead of the control according to the present embodiment. The image forming apparatus A was compared with the image forming apparatuses in Comparative Examples 1 and 2 for inappropriate transfer and stripes corresponding to inappropriate images resulting from scrape-off of the photosensitive drum. The checks were conducted in the low-temperature and low-humidity environment (a temperature of 15° C. and a humidity of 10%) in which the abnormal discharge is likely to occur and in which the surface of the photosensitive drum 1 is likely to be scraped off.

Compared to the configuration in the present embodiment, a configuration in Comparative Example 1 started irradiation from the pre-exposure apparatus 27 immediately before the start of the ATVC. Compared to the configuration in the present embodiment, a configuration in Comparative Example 2 had started irradiation from the pre-exposure apparatus 27 a given time interval T before the ATVC was started. The time interval T was equal to the maximum abnormal-discharge period in the low-temperature and low-humidity environment in which the abnormal discharge is most likely to occur. To check for inappropriate transfer, transfer efficiency was measured and evaluated. In the evaluation, a transfer efficiency of 95% or more was represented by ○, whereas a transfer efficiency of less than 95% was represented by ×. After 50,000 images were formed, the images were checked for defects resulting from scrape-off of the photosensitive drum surface based on possible stripes in the images and the levels of the stripes. In the evaluation, the absence of stripes was represented by ○, whereas the presence of clear stripes was represented by ×.

Table 1 illustrates comparison of the results of experiments between the present embodiment and the conventional examples. As is apparent from. Table 1, when the control in the present embodiment was performed, appropriate results were produced with the transfer efficiency prevented from decreasing over a long period of use regardless of the number of images formed. No stripes resulting from scrape-off of the photosensitive drum were created. In contrast, in Comparative Example 1, no stripes resulting from scrape-off of the photosensitive drum were created, but the transfer efficiency decreased. In Comparative Example 2, the transfer efficiency was prevented from decreasing, but stripes resulting from scrape-off of the photosensitive drum were created.

TABLE 1

| | TRANSFER EFFICIENCY | STRIPES |
|---|---|---|
| EMBODIMENT 1 | ○ | ○ |
| COMPARATIVE EXAMPLE 1 | x | ○ |
| COMPARATIVE EXAMPLE 2 | ○ | x |

As described above, in the present embodiment, the time from the start of irradiation from the pre-exposure apparatus 27 until the start of the ATVC was optimized according to the length of the abnormal-discharge period. Thus, the life of the image forming apparatus can be extended with the accuracy of the ATVC prevented from decreasing over a long period of use. The abnormal-discharge period can be acquired based on the number of images formed, which is a piece of the information on the photosensitive member film thickness in the photosensitive drum 1, and the temperature and the humidity, which correspond to the information on the use environment. These pieces of information are stored in the storage means 26 mounted in the process cartridge.

In the present embodiment, the abnormal-discharge period is sensed, and the start of irradiation from the pre-exposure apparatus 27 is advanced only when the abnormal discharge is occurring. However, a time adjustment method is not limited to this. Any time adjustment method may be used so long as the time from the start of irradiation from the pre-exposure apparatus 27 until the start of the ATVC is increased. For example, the time of the start of the ATVC may be delayed with the time of the start of irradiation from the pre-exposure apparatus 27 fixed. Alternatively, the desired time interval maybe controllably achieved by advancing the time of the start of irradiation from the pre-exposure apparatus 27 while delaying the time of the start of the ATVC. The photosensitive drum 1 rotates at a given speed, and thus, the time adjustment changes the number of rotations of the photosensitive drum 1 (or the traveling distance of the photosensitive drum 1) between the timing for the start of the pre-exposure and the timing for the start of the ATVC.

In the present embodiment, the storage means 26 is provided in the process cartridge B. Consequently, the information on the photosensitive member film thickness and the temperature and the humidity can be retained in the process cartridge itself. Therefore, for example, even when the process cartridge B that has not reached the end of the life thereof is removed from the apparatus main body 13 and replaced with a new one, the information on the photosensitive member film thickness and the temperature and the humidity that are appropriate to the process cartridge B can very advantageously be constantly recognized by the apparatus main body. However, aspects to which the present invention is applicable are not limited to this. The principle of the present invention is applicable to an apparatus main body provided with storage means, and in this case, effects similar to those of the present embodiment can be produced.

The present invention is also applicable to a configuration in which the image forming apparatus includes no process cartridge, and still produces effects similar to those of the present embodiment. In this case, storage means is provided in the apparatus main body to store the photosensitive member film thickness and the information on the temperature and the humidity. Then, for example, when the photosensitive drum is separately replaced with a new one, the information on the photosensitive member film thickness and the temperature and the humidity in the storage means may be reset.

As described above, the likelihood of the abnormal discharge increases consistently with the magnitude of the charging potential Vd. For a latent image setting in the present embodiment, Vd=−500 V regardless of the film thickness of the photosensitive layer in the photosensitive member. However, if, for example, the charging potential Vd varies according to a use period, the abnormal-discharge period may be corrected in accordance with the charging potential Vd. In the present embodiment, the abnormal-discharge period is calculated (acquired) using two pieces of information including the information on the film thickness of the photosensitive drum 1 and the information on the use environment. However, the abnormal-discharge period may be calculated based on one of these pieces of information. Instead of or in addition to the direct calculation of the abnormal-discharge period, measurement of, for example, a charging current flowing through the charging roller 2 is possible in which, based on the time when the current falls outside a predetermined range, the time from the start of pre-exposure irradiation until the start of the ATVC may be varied.

Embodiment 2

The abnormal-discharge period depends on the resistance value of the charging roller 2. As described above, the abnormal-discharge period increases with decreasing resistance value of the charging roller 2 and decreases with an increasing resistance value of the charging roller 2. Thus, Embodiment 2 of the present invention is characterized by calculating the abnormal-discharge period based on information on the charging capability of the charging roller 2 in addition to the information on the film thickness of the photosensitive drum 1 and the information on the use environment. Embodiment 2 is otherwise the same as Embodiment 1, and components of Embodiment 2 similar to the corresponding components of Embodiment 1 will not be described.

The charging capability of the charging roller 2 is correlated with the resistance value of the charging roller 2. The resistance value fluctuates over a long period of use and is thus proportional to the charging bias application time and the integrated amount of charging current (the integrated value of the amount of current flowing through the charging roller). The resistance value also fluctuates according to the temperature and the humidity. In the present embodiment, the resistance value of the charging roller 2 when still new is stored in the storage means 26.

In the present embodiment, an approximate curve is determined based on a relation between the abnormal-discharge period and the film thickness of the photosensitive drum, a relation between the abnormal-discharge period and the resistance value of the charging roller, and a relation between the abnormal-discharge period and the use environment. The corresponding data is stored in the ROM 33 in the image forming apparatus main body. For the sensing of the abnormal-discharge period, the abnormal-discharge period is calculated by adopting data on the approximate curve stored in the ROM 33 that corresponds to the information on the film thickness of the photosensitive drum 1, the information on the temperature and humidity, and the resistance value of the charging roller 2 stored in the storage means 26.

As described above, the storage means 26 mounted in the process cartridge B stores the number of images formed, which is a piece of information on the photosensitive member film thickness in the photosensitive drum 1, the temperature and the humidity, and the resistance value of the charging roller 2. The time from the start of irradiation from the pre-exposure apparatus 27 until the start of the ATVC is optimized in association with the information stored in the storage means 26. Thus, the life of the image forming apparatus can be extended with the accuracy of the ATVC prevented from decreasing over a long period of use.

In the present embodiment, the abnormal-discharge period is calculated using the resistance value of the charging roller 2 when still new, as information on the charging capability of the charging roller 2. A manner of utilizing the information on the charging capability of the charging roller 2 is not limited to this. For example, the abnormal-discharge period may be corrected with fluctuations in resistance value over a long period of use and environmental fluctuations taken into account based on the information such as the charging bias application time, the integrated amount of charging current, and the temperature and the humidity.

Embodiment 3

The abnormal-discharge period can be sensed (acquired) by measuring the transfer current value. In Embodiment 3 of the present invention, effects similar to the effects of Embodiments 1 and 2 can be produced by using the sensed abnormal-discharge period to vary the time from the start of irradiation from the pre-exposure apparatus 27 until the start of the ATVC. Components of Embodiment 3 that are common to Embodiments 1 and 2 will not be described below. Matters in Embodiment 3 that will not be described below are similar to the corresponding matters in Embodiments 1 and 2.

<Method for Sensing the Abnormal-Discharge Period>

In the present embodiment, the transfer current flowing through the transfer roller 5 is detected, and the abnormal-discharge period is calculated (acquired) based on the value of the transfer current. The transfer current flowing through the transfer roller 5 is detected using a current detecting portion 40. To sense the abnormal-discharge period, measurement is performed with the transfer bias fixed to a predetermined value.

Figure 9:
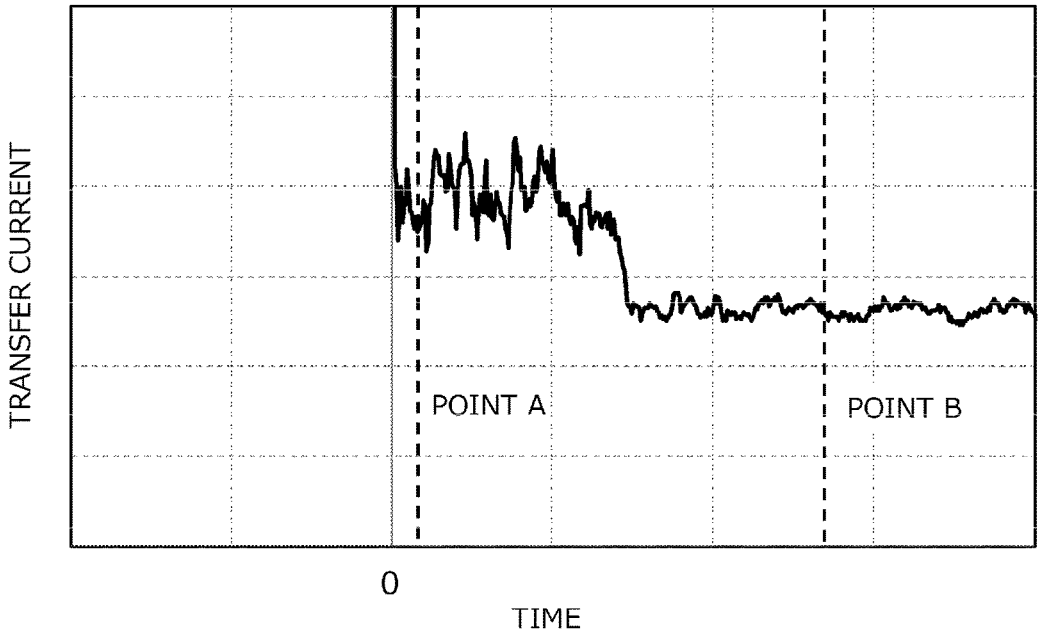
FIG. 9 is a diagram illustrating time transition of a transfer current value.

FIG. 9 illustrates time transition of the transfer current value obtained when the abnormal discharge occurs as a result of irradiation from the pre-exposure apparatus 27 following the application of the charging bias. Time 0 is defined as a time (fourth timing) when the position (pre-exposure start position) on the photosensitive drum 1 where the irradiation from the pre-exposure apparatus 27 starts arrives at a nip portion (transfer position) of the transfer roller 5. Near the pre-exposure irradiation start position, the abnormal discharge occurs during charging to increase the surface potential of the photosensitive drum 1 above a normal value, thus increasing the transfer current above a normal value. However, the abnormal discharge soon converges to return the transfer current to the normal value.

Figure 10:
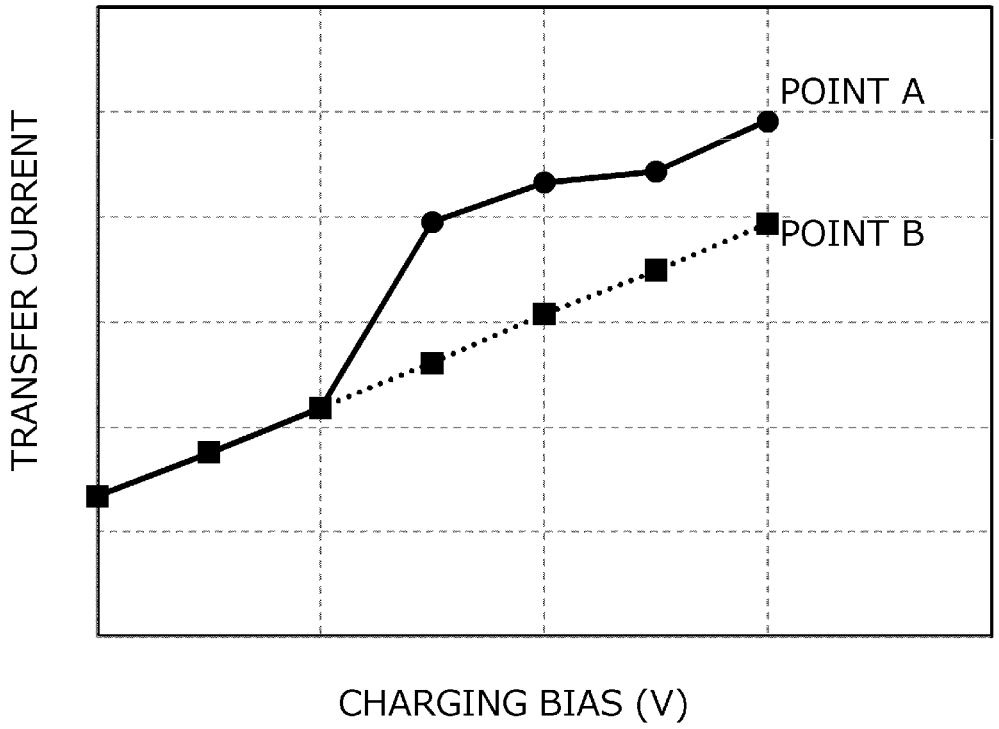
FIG. 10 is a diagram illustrating a relation between the transfer current value and a charging bias.

FIG. 10 illustrates a relation between the transfer current value and the charging bias at a point A corresponding to a point in time immediately after time 0 depicted in FIG. 9. At the point A, when the charging bias increases, the transfer current value increases, at a certain bias value, in a phase transition manner as a result of the abnormal discharge. FIG. 10 also illustrates a relation between the transfer current value and the charging bias at a point B depicted in FIG. 9. At the point B, the abnormal discharge converges to return the transfer current to the normal value. At the point B, the charging bias and the transfer current value have a linear relation. This straight line coincides with a straight line of the transfer current value at the point A at a bias equal to or lower than the bias at which the abnormal discharge occurs. Thus, a relation between the normal transfer current and the charging bias is determined based on values for the measurement point A at a bias lower than the bias at which the abnormal discharge occurs.

In the present embodiment, with the transfer bias fixed, an approximate straight line is determined based on the transfer current measured at two points at a charging bias value equal to or lower than the bias at which the abnormal discharge occurs. A transfer current value obtained from the approximate straight line is determined to be a normal transfer current value. A manner of determining the approximate straight line is not limited to this. Any manner may be executed so long as two or more measurement points are used. The accuracy can be increased consistently with the number of measurement points. Then, based on the relation between the normal transfer current value and the charging bias, the normal transfer current value at the desired charging bias at a predetermined transfer bias can be determined.

For the sensing of the abnormal-discharge period, the abnormal-discharge period can be calculated by comparing the value of the transfer current flowing when the desired charging bias is applied with the value of the transfer current flowing during normal discharge.

Figure 11:
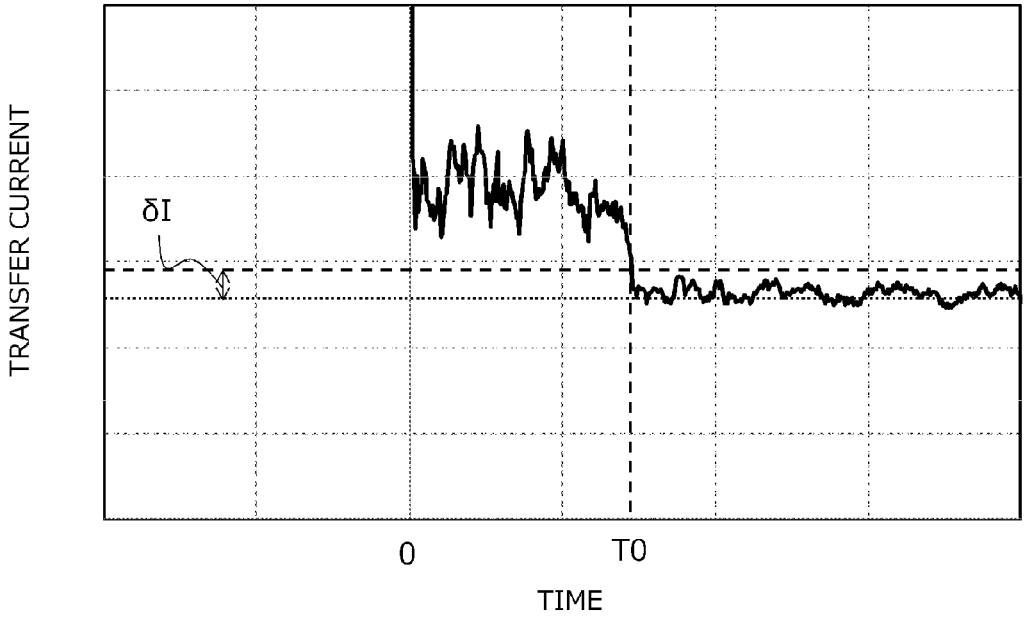
FIG. 11 is a diagram illustrating time transition of the transfer current value.

FIG. 11 is a diagram illustrating time transition of the transfer current value obtained when the abnormal discharge occurs as a result of irradiation from the pre-exposure apparatus 27 following the application of the charging bias. In the present embodiment, the abnormal-discharge period (To) is determined to be a time from a point in time when the pre-exposure irradiation start position arrives at the nip portion of the transfer roller 5 (time 0) until the transfer current value falls within a predetermined range of current values (within a threshold range) (δI) with respect to the normal transfer current (fifth timing). This method is used to calculate the abnormal-discharge period, and the time from the start of irradiation from the pre-exposure apparatus 27 until the start of the ATVC is controlled and adjusted.

<Method for Controlling the Time from the Start of Irradiation from the Pre-exposure Apparatus Until the Start of the ATVC>

Figure 12:
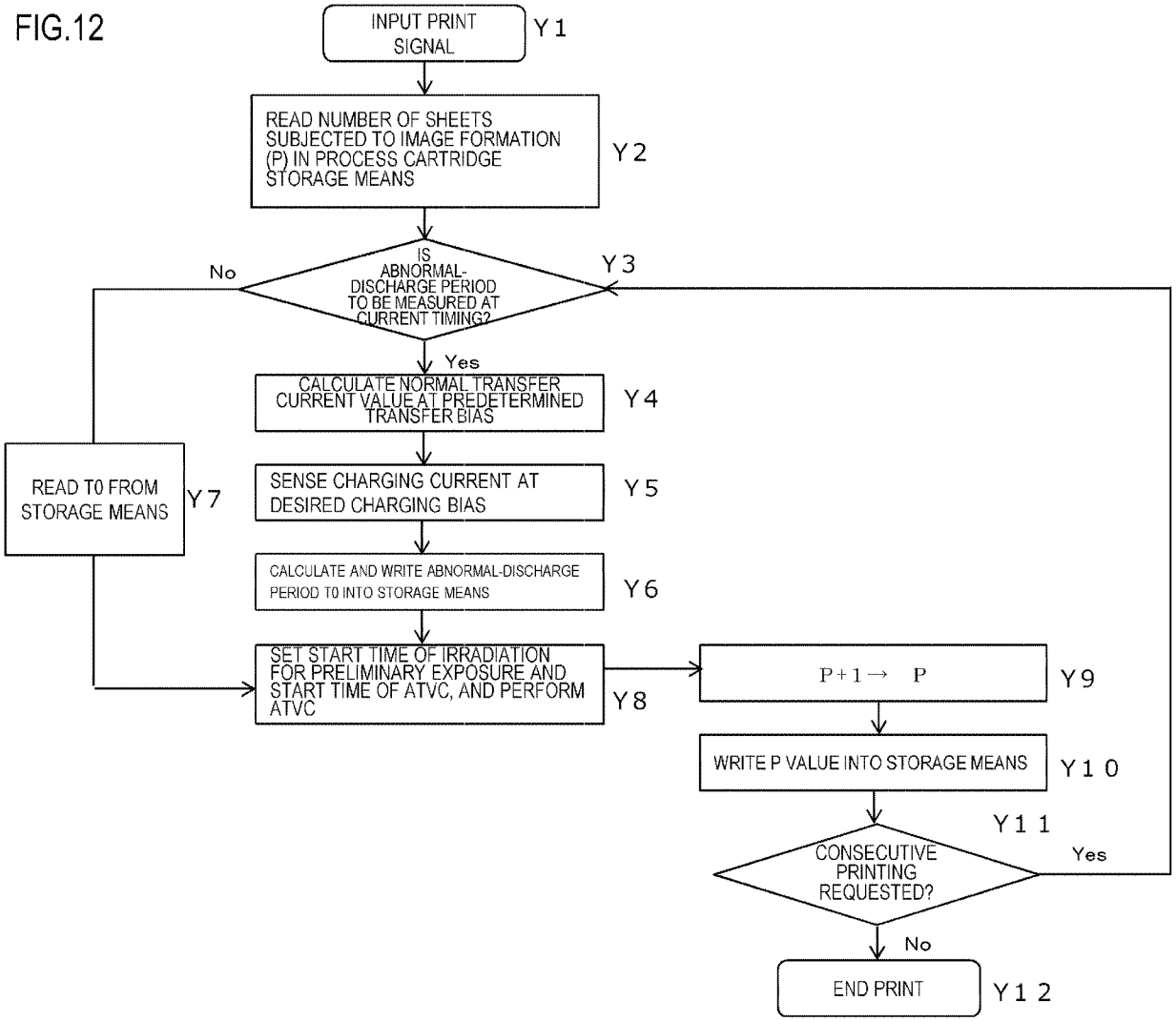
FIG. 12 is a flowchart of control for the pre-exposure start time in Embodiment 3 of the present invention.

With reference to a flowchart in FIG. 12, a method for controlling the time from the start of irradiation from the pre-exposure apparatus 27 until the start of the ATVC in the present embodiment will be described. The process cartridge B includes the storage means 26, and the storage means 26 stores the number of images formed using the process cartridge B. When the host 14 inputs the print signal to the image forming apparatus (Y1), the CPU 32 communicates with the storage means 26 mounted in the process cartridge B to load the number of images formed (P) for the process cartridge B, the temperature, and the humidity (Y2).

Then, the CPU 32 checks whether to sense the abnormal-discharge period T0 at the current timing (Y3). At Y3, the CPU 32 checks whether the temperature and the humidity are equal to or lower than prescribed thresholds and whether the number of images formed (P) is equal to a prescribed number. In the present embodiment, sensing timings based on the number of sheets correspond to zeroth sheet and every 2000th sheet. Sensing timings based on the temperature and the humidity correspond to points in time when the absolute moisture content calculated from the temperature and the humidity varies by ±1 g/m$^3$ with respect to the last sensing value. However, the present embodiment is not limited to this, and the timings may be set according to the life of the image forming apparatus, the charging capability of the charging roller 2, and the like.

A point in time when the temperature or the humidity exceeds the threshold or the number of sheets formed is equal to the prescribed value corresponds to a sensing timing. At the sensing timing, the relation between the normal transfer current and the charging bias at the predetermined transfer bias value is determined using the above-described method (Y4). Then, the transfer current value at the desired charging bias at the predetermined transfer bias is measured (Y5). The abnormal-discharge period T0 is calculated (acquired) by comparing the value of the transfer current flowing when the desired charging bias is applied with the value of the transfer current flowing during normal discharge, and is written to the storage portion (Y6). When the number of sheets formed fails to be equal to the prescribed value and the temperature and the humidity are equal to or lower than the thresholds, the abnormal-discharge period T0 is loaded from the storage means (Y7). Then, based on the value of the abnormal-discharge period T0, the control portion 35, which controls the time from the start of irradiation from the pre-exposure apparatus 27 until the start of the ATVC, sets the time from the start of irradiation from the pre-exposure apparatus 27 until the start of the ATVC, and shifts to the image forming operation (Y8).

When the time from the start of irradiation from the pre-exposure apparatus 27 until the start of the ATVC is set based on the value of the abnormal-discharge period T0, it is necessary to take into account a variation in abnormal-discharge period occurring when the temperature and the humidity are equal to or lower than the thresholds. In the present embodiment, the maximum amount of change in abnormal-discharge period occurring when the absolute moisture content varies by 1 g/m$^3$ is predetermined based on relations between the photosensitive drum 1 with the initial film thickness and the absolute moisture content in the charging roller 2 with the smallest one of varying resistance values and the abnormal-discharge period. The time from the start of irradiation from the pre-exposure apparatus 27 until the start of the ATVC is controlled based on a value resulting from correction of the abnormal-discharge period T0 by an amount equal to the maximum amount of change.

When the image forming operation ends, the count of the number of images formed is increased by one (Y9), and the count of the number of images formed in the storage means 26 in the process cartridge B is rewritten (Y10). Subsequently, the control portion 35 determines whether any request for consecutive printing has been received (Y11). When no request has been received, the control portion 35 shifts to a print ending operation (Y12). When any request has been received, the operations in Y3 to Y11 are repeated until no other request is found.

As described above, in the present embodiment, the value of the transfer current flowing through the transfer roller 5 can be detected so as to enable the abnormal-discharge period to be calculated based on the detected transfer current value. Thus, as is the case with Embodiments 1 and 2, the time from the start of irradiation from the pre-exposure apparatus 27 until the start of the ATVC can be optimized. This allows the life of the image forming apparatus to be extended with the accuracy of the ATVC prevented from decreasing over a long period of use. In the present embodiment, the value of the transfer current flowing through the transfer roller 5 is sensed. However, a ground current may be measured. The abnormal-discharge period can also be sensed as is the case with the present embodiment by providing a charge detecting portion that detects the value of a charging current flowing through the charging roller 2 and measuring the charging current value using the charge detecting portion.

Embodiment 4

The abnormal-discharge period T0 can also be sensed during the ATVC. In the present embodiment, the abnormal-discharge period is sequentially sensed during consecutive printing, and the time from the start of irradiation from the pre-exposure apparatus 27 until the start of the ATVC is sequentially varied using the sensed value. Components of Embodiment 4 that are common to Embodiments 1 to 3 will not be described below. Matters in Embodiment 4 that will not be described below are similar to the corresponding matters in Embodiments 1 to 3.

<Method for Sensing the Abnormal-Discharge Period>

A method for sensing the abnormal-discharge period during the ATVC will be described. The abnormal-discharge period is sensed while the transfer bias has an adjustment voltage value V1. The abnormal-discharge period can be sensed by measuring the value of the transfer current flowing through the transfer roller 5 while the ATVC is in execution.

Figure 13:
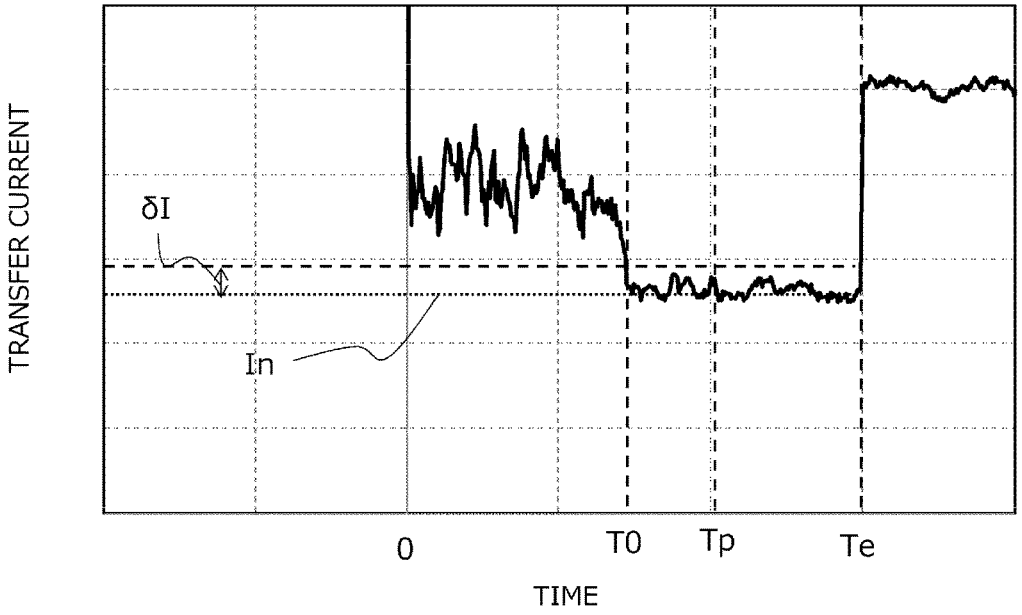
FIG. 13 is a diagram illustrating time transition of the transfer current value.

FIG. 13 is a diagram illustrating time transition of the transfer current value observed while the ATVC is in execution. Time 0 is defined as a point in time when the position on the photosensitive drum 1 where the irradiation from the pre-exposure apparatus 27 starts arrives at the nip portion of the transfer roller 5. A normal transfer current value obtained while no abnormal discharge is occurring is determined by calculating the average value (In) of the transfer current values from a point in time when the ATVC starts to be executed (Tp) (sixth timing) until the transfer bias changes from the adjustment voltage value V1 to V2 (Te) (seventh timing). The point in time when the ATVC starts to be executed Tp is determined based on the sensed abnormal-discharge period or the abnormal-discharge period calculated using the information on the use environment and the information on the temperature and the humidity. Consequently, the normal transfer current flows after the point in time when the ATVC starts to be executed Tp. The abnormal-discharge period T0 is determined by calculating the time when the point on the photosensitive drum 1 where the irradiation from the pre-exposure apparatus 27 starts arrives at the nip portion of the transfer roller 5 (time 0) until the transfer current value falls within the predetermined range of current values (within a threshold range) (δI) with respect to the normal transfer current value In.

<Method for Controlling the Time from the Start of Pre-exposure Irradiation until the Start of the ATVC>

Figure 14:
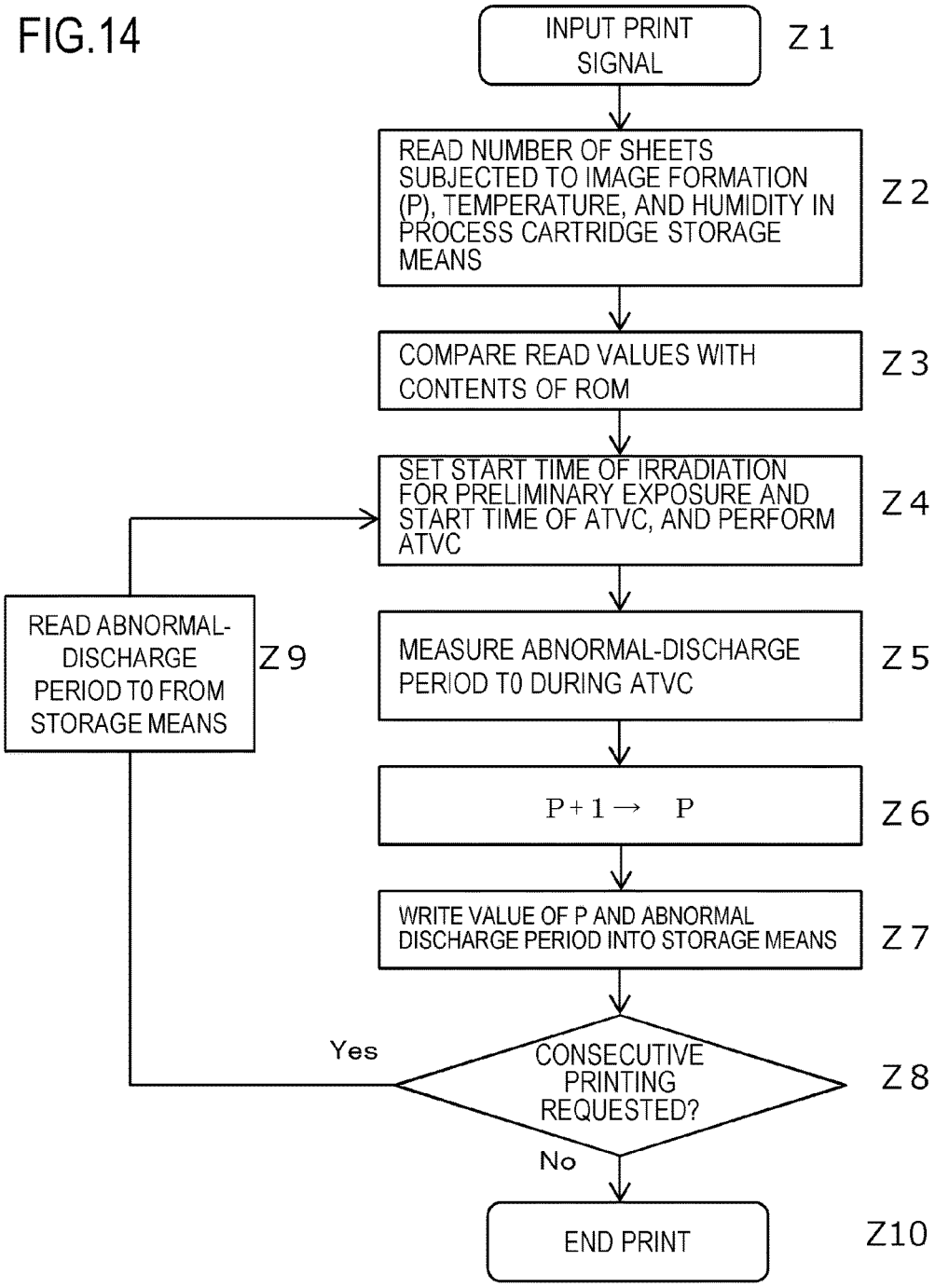
FIG. 14 is a flowchart of control for the pre-exposure start time in Embodiment 4 of the present invention.

With reference to a flowchart in FIG. 14, a method for controlling the time from the start of irradiation from the pre-exposure apparatus 27 until the start of the ATVC will be described. The process cartridge B includes the storage means 26 that stores the number of images formed using the process cartridge B, the temperature, and the humidity. When the host 14 inputs the print signal to the image forming apparatus (Z1), the CPU 32 communicates with the storage means 26 mounted in the process cartridge B to load the number of images formed (P) for the process cartridge B, the temperature, and the humidity (Z2). Then, the CPU 32 compares the contents of the ROM 33 in the image forming apparatus main body, in which the abnormal-discharge period corresponding to the number of images formed, the temperature, and the humidity is pre-stored, with the number of images formed (P), the temperature, and the humidity loaded into the CPU 32 as described above. Then, the CPU 32 allows the control portion 35, which controls the time from the start of irradiation from the pre-exposure apparatus 27 until the start of the ATVC, to set the time from the start of irradiation from the pre-exposure apparatus 27 until the time of the start of the ATVC and to shift to an image forming operation (Z4). While the ATVC is in execution, the abnormal-discharge period T0 is measured using the above-described method (Z5).

When the image forming operation ends, the count of the number of image formed is increased by one (Z6). The count of the number of images formed and the abnormal-discharge period T0 are written to the storage means 26 in the process cartridge B (Z7). Subsequently, the control portion 35 determines whether any request for consecutive printing has been received (Z8). When any request has been received, the abnormal-discharge period T0 is loaded from the storage means (Z9), and the operations in Z4 to Z9 are repeated until no other request for consecutive printing is found. When no other request is found, the control portion 35 shifts to the print ending operation (Z10).

As described above, in the present embodiment, the abnormal-discharge period is sequentially sensed during consecutive printing, and the time from the start of irradiation from the pre-exposure apparatus 27 until the start of the ATVC is optimized using the sensed value. Thus, the life of the image forming apparatus can be extended with the accuracy of the ATVC prevented from decreasing over a long period of use. In the present embodiment, the abnormal-discharge period is calculated (acquired) using the information on the use environment and the information on the temperature and the humidity. However, the abnormal-discharge period may be sensed as in the case of Embodiment 3. In the present embodiment, the value of the transfer current flowing through the transfer roller 5 is sensed. However, the ground current may be measured. The abnormal-discharge period can also be sensed as is the case with the present embodiment by providing a charge detecting portion that detects the value of a charging current flowing through the charging roller 2 and measuring the charging current value using the charge detecting portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-152509, filed Jul. 31, 2015, which is hereby incorporated by reference herein in its entirety.

What is claimed is:

1. An image forming apparatus comprising:

an image bearing body that bears a developer image to be transferred to a recording material;

a charging member that charges the image bearing body;

a transfer member that transfers a developer image formed by development, using a developer, of an electrostatic image formed by exposure of the charged image bearing body, from the image bearing body to a transferred body;

a voltage applying portion that applies a voltage to each of the charging member and the transfer member;

a current detecting portion that detects a current flowing through the transfer member;

a preliminary exposing portion that exposes the image bearing body after the developer image is transferred and before the image bearing body is charged by the charging member;

a setting portion that sets a value of a transfer voltage applied to the transfer member by the voltage applying portion during image formation; and an acquiring portion is provided which acquires a duration of an overcharged state occurring in an area of the image bearing body charged by the charging member after the image bearing body is exposed by the preliminary exposing portion, wherein an adjustment operation being performed before image formation is started and after the charging member charges the image bearing body, the adjustment operation involving the voltage applying portion applying a voltage with a predetermined adjustment voltage value to the transfer member and the setting portion setting the transfer voltage value based on a current value detected by the current detecting portion when the voltage applying portion applies the voltage, and wherein adjustment is made to an interval between a first timing when the preliminary exposing portion starts exposing the image bearing body before execution of the adjustment operation and a second timing when the voltage applying portion starts, during the subsequent adjustment operation, applying the voltage with the adjustment voltage value to the transfer member such that the second timing is later than a third timing when the duration acquired by the acquiring portion ends.

2. The image forming apparatus according to claim 1, wherein the interval is adjusted so as to decrease consistently with the acquired duration.

3. The image forming apparatus according to claim 1, wherein the interval is adjusted by varying the first timing.

4. The image forming apparatus according to claim 1, wherein the interval is adjusted by varying the second timing.

5. The image forming apparatus according to claim 1, wherein the acquiring portion acquires the duration based on at least one of information on a film thickness of a photosensitive layer in the image bearing body and information on a use environment of the image forming apparatus.

6. The image forming apparatus according to claim 1, wherein the acquiring portion acquires the duration based on at least one of information on a film thickness of a photosensitive layer in the image bearing body, information on a use environment of the image forming apparatus, and information on a charging capability of the charging member.

7. The image forming apparatus according to claim 6, wherein the information on the charging capability is acquired based on at least one of a resistance value of the charging member, a time for which a voltage is applied to the charging member, and an integrated value of a current flowing through the charging member.

8. The image forming apparatus according to claim 5, wherein the information on the film thickness is acquired based on one of pieces of information including a number of recording materials on which image formation has been performed, a rotation speed of the image bearing body as a rotating body, a number of recording materials having passed through the image forming apparatus, and a time for which the image bearing body has been charged by the charging member.

9. The image forming apparatus according to claim 5, wherein the information on the use environment is a temperature and a humidity sensed by a temperature and humidity sensor.

10. The image forming apparatus according to claim 9, wherein the interval is adjusted to decrease with an increasing absolute moisture content acquired based on the temperature and the humidity sensed by the temperature and humidity sensor.

11. The image forming apparatus according to claim 5, wherein the interval is adjusted to decrease consistently with the film thickness of the photosensitive layer.

12. The image forming apparatus according to claim 1, wherein the acquiring portion acquires the duration based on the current value detected by the current detecting portion.

13. The image forming apparatus according to claim 12, wherein based on the current value detected by the current detecting portion, the acquiring portion acquires the duration by determining a period from a fourth timing when a position on the image bearing body where the preliminary exposing portion starts exposure arrives at a position where the developer image is transferred by the transfer member until a fifth timing when the current value detected by the current detecting portion falls within a predetermined threshold range.

14. The image forming apparatus according to claim 12, wherein the acquiring portion acquires the duration when a temperature and a humidity sensed by a temperature and humidity sensor exceed predetermined thresholds or when a number of recording materials on which image formation has been performed is equal to a predetermined number.

15. The image forming apparatus according to claim 1, wherein the acquiring portion acquires the duration based on the current value detected by the current detecting portion when the voltage applying portion applies the voltage with the adjustment voltage value to the transfer member during the adjustment operation.

16. The image forming apparatus according to claim 15, wherein during the adjustment operation, the voltage applying portion first applies a voltage with a first adjustment voltage value of a first magnitude and then a voltage with a second adjustment voltage value of a second magnitude, and the acquiring portion acquires an average value of current values detected by the current detecting portion between a sixth timing when the voltage applying portion applies the voltage with the first adjustment voltage value and a seventh timing when the voltage value of the voltage applied by the voltage applying portion is switched from the first adjustment voltage value to the second adjustment voltage value, and determines the average value to be a normal transfer current value obtained while no overcharged state is occurring.

17. The image forming apparatus according to claim 16, wherein based on the current value detected by the current detecting portion, the acquiring portion acquires the duration by determining a period from a fourth timing when a position on the image bearing body where the preliminary exposing portion starts exposure arrives at a position where the developer image is transferred by the transfer member until a fifth timing when the current value detected by the current detecting portion falls within a predetermined current value range with respect to the normal transfer current value.

18. The image forming apparatus according to claim 1, wherein the voltage applying portion applies to the charging member, during the adjustment operation, a voltage with the same voltage value as that of a voltage applied during image formation.

19. The image forming apparatus according to claim 1, wherein the voltage applied to the charging member by the voltage applying portion is a direct-current voltage.

20. The image forming apparatus according to claim 1, wherein the transferred body is a recording material, or an intermediate transfer member to which the developer image is transferred from the image bearing body and from which the transferred developer image is transferred to the recording material.

21. The image forming apparatus according to claim 1, wherein the image bearing body is configured as a cartridge that is removable from an apparatus main body of the image forming apparatus, and the cartridge has a storage portion that stores at least one of information on a film thickness of a photosensitive layer in the image bearing body, information on a use environment of the image forming apparatus, and information on a charging capability of the charging member.

* * * * *